US008079353B2

(12) United States Patent
Davis et al.

(10) Patent No.: US 8,079,353 B2
(45) Date of Patent: Dec. 20, 2011

(54) ARCHERY BOW HAVING A MULTIPLE-TUBE STRUCTURE

(75) Inventors: Stephen J. Davis, Newtown, PA (US); Mauro Pezzato, Treviso (IT); Mauro Pinaffo, Camposampiero (IT); Roberto Gazzara, Mestre (IT); Michele Pozzobon, Fossalunga di Vedelago (IT); Stefano Conte, Paese (IT)

(73) Assignee: Prince Sports, Inc., Bordentown, NJ (US)

( * ) Notice: Subject to any disclaimer, the term of this patent is extended or adjusted under 35 U.S.C. 154(b) by 669 days.

(21) Appl. No.: 12/043,399

(22) Filed: Mar. 6, 2008

(65) Prior Publication Data

US 2009/0050125 A1 Feb. 26, 2009

Related U.S. Application Data

(60) Provisional application No. 60/905,358, filed on Mar. 7, 2007.

(51) Int. Cl.
*F41B 5/00* (2006.01)

(52) U.S. Cl. ..... 124/23.1; 124/25.6; 124/86; 124/88

(58) Field of Classification Search ..... 124/23.1, 124/25.6, 88, 86
See application file for complete search history.

(56) References Cited

U.S. PATENT DOCUMENTS 1,810,335 A * 6/1931 Barnhart ..... 124/23.1
2,736,309 A * 2/1956 Hoffman ..... 124/23.1
3,625,193 A * 12/1971 Palma ..... 124/23.1
3,923,036 A * 12/1975 Jennings et al. ..... 124/88
4,086,901 A * 5/1978 Clement ..... 124/21
4,350,138 A * 9/1982 Caldwell ..... 124/25.6
4,358,113 A * 11/1982 McKinnon et al. ..... 473/561
4,600,193 A * 7/1986 Merritt ..... 473/566
4,644,928 A * 2/1987 Studanski ..... 124/24.1
4,644,929 A * 2/1987 Peck ..... 124/23.1
4,669,445 A * 6/1987 Schaar ..... 124/25.6
5,099,819 A * 3/1992 Simonds et al. ..... 124/23.1
5,247,920 A * 9/1993 Harbin ..... 124/20.1
5,429,106 A * 7/1995 Martin et al. ..... 124/23.1
5,454,361 A * 10/1995 Bronnert ..... 124/23.1
5,682,871 A * 11/1997 Walk et al. ..... 124/88
5,720,267 A * 2/1998 Walk ..... 124/23.1
5,722,380 A * 3/1998 Land et al. ..... 124/25.6
5,749,351 A * 5/1998 Allshouse et al. ..... 124/25.6
5,894,835 A * 4/1999 Simonds ..... 124/23.1
5,921,227 A * 7/1999 Allshouse et al. ..... 124/25.6
5,947,099 A * 9/1999 Derus ..... 124/25.6
6,019,097 A * 2/2000 Cox et al. ..... 124/23.1
6,024,076 A * 2/2000 Laborde et al. ..... 124/23.1
6,142,132 A * 11/2000 Simonds ..... 124/23.1
6,588,411 B1 * 7/2003 Simonds ..... 124/23.1
6,684,870 B1 * 2/2004 Land ..... 124/23.1
6,698,413 B1 * 3/2004 Ecklund ..... 124/25.6
6,712,057 B2 * 3/2004 Andrews ..... 124/23.1
6,715,479 B1 * 4/2004 Bunk ..... 124/25.6
6,776,148 B1 * 8/2004 Islas ..... 124/25.6
6,786,214 B2 * 9/2004 Andrews ..... 124/23.1
6,964,271 B2 * 11/2005 Andrews ..... 124/25.6
7,066,165 B2 * 6/2006 Perry ..... 124/23.1

(Continued)

*Primary Examiner* — Gene Kim
*Assistant Examiner* — Alexander Niconovich
(74) *Attorney, Agent, or Firm* — Abelman, Frayne & Schwab

(57) ABSTRACT

An archery bow is formed of multiple composite tubes bonded to one another along a common wall, wherein apertures, or "ports," are molded between the tubes to improve the stiffness, strength, resiliency, control, and aerodynamics of the bow.

21 Claims, 22 Drawing Sheets

U.S. PATENT DOCUMENTS

| | | | | |
|---|---|---|---|---|
| 7,089,923 | B2 * | 8/2006 | Johnson | 124/1 |
| 7,201,161 | B1 * | 4/2007 | York | 124/16 |
| 7,308,890 | B1 * | 12/2007 | Wheeler | 124/23.1 |
| 7,318,429 | B2 * | 1/2008 | Achkar | 124/86 |
| 7,373,934 | B2 * | 5/2008 | Smith et al. | 124/25.6 |
| 7,637,256 | B2 * | 12/2009 | Lee | 124/25.6 |
| 7,909,713 | B2 * | 3/2011 | Davis et al. | 473/561 |
| 2003/0084893 | A1 * | 5/2003 | Andrews | 124/23.1 |
| 2004/0094139 | A1 * | 5/2004 | Andrews | 124/23.1 |
| 2004/0187855 | A1 * | 9/2004 | Wheeler | 124/25.6 |
| 2005/0153799 | A1 * | 7/2005 | Rigoli | 473/513 |
| 2006/0011181 | A1 * | 1/2006 | Andrews | 124/23.1 |
| 2006/0247077 | A1 * | 11/2006 | Deetz | 473/513 |
| 2007/0084451 | A1 * | 4/2007 | Perry | 124/23.1 |
| 2007/0101980 | A1 * | 5/2007 | Sims et al. | 124/25.6 |
| 2007/0193567 | A1 * | 8/2007 | D'Acquisto | 124/23.1 |
| 2007/0193568 | A1 * | 8/2007 | Lee | 124/25.6 |
| 2007/0200422 | A1 * | 8/2007 | Davis et al. | 301/95.106 |
| 2007/0222178 | A1 * | 9/2007 | Davis et al. | 280/281.1 |
| 2007/0270253 | A1 * | 11/2007 | Davis et al. | 473/513 |
| 2009/0000606 | A1 * | 1/2009 | Cooper et al. | 124/25.6 |
| 2009/0145411 | A1 * | 6/2009 | Sims et al. | 124/25.6 |
| 2009/0178327 | A1 * | 7/2009 | Davis et al. | 43/18.1 R |
| 2009/0241928 | A1 * | 10/2009 | Blosser | 124/25.6 |
| 2009/0260609 | A1 * | 10/2009 | Park | 124/23.1 |
| 2010/0000504 | A1 * | 1/2010 | Trpkovski | 124/25.6 |

* cited by examiner

ARCHERY BOW HAVING A MULTIPLE-TUBE STRUCTURE

RELATED APPLICATIONS

This application claims the benefit of U.S. Provisional Application Ser. No. 60/905,358, filed Mar. 7, 2007, entitled "Archery Bow Having A Multiple Tube Structure"

FIELD OF THE INVENTION

The present invention relates to an archery bow, and, more particularly, to an archery bow composed of a composite material having ports defined in portions thereof.

BACKGROUND OF THE INVENTION

The traditional bow, also called a long bow, is typically a solid or laminated wood structure having a variable cross section which is larger in the handle region and which transitions to a generally flat cross section in the limb area, away from the central region.

A more contemporary bow, called a recurve bow, is shaped such that the tips of the limbs of the bow curve away from the archer. This allows for improved spring back and higher arrow velocities. A still more contemporary bow, called a compound bow, has a wheel and pulley mechanism, which further enhances arrow velocity.

The bow originated as a single piece structure made of a single piece of wood. The bow structure was later designed with laminated wood to take advantage of combining different species of wood as well as using strengthening adhesives to bond the plies together. While the laminated structure can resist repeated flexing and is very durable, some disadvantages exist. A laminated structure is limited to a flat geometry, which is an inefficient design when the bow limb is traveling through the air. When the bow is fully loaded and the bow limbs are undergoing maximum deflection, the faster they are able to return, the higher arrow velocity. In addition, the flat panel shaped of a laminated structure has very poor torsional properties. This can decrease the accuracy of the bow system.

Further improvements were made by adding fiber reinforced composites to the wood laminated bow structure. Fibers such as fiberglass, aramid, and carbon fiber have been used in a variety of polymer matrices.

The bow was further advanced by separating the central region (the riser) from the two outer regions (the limbs). The combination of a rigid riser with flexible limbs created a more powerful and accurate bow.

The performance of an archery bow, measured in terms of accuracy, arrow velocity, and numerous other factors, can be affected by a number of characteristics of the bow, such as weight, bending flex, resiliency, vibration damping, and strength.

Arrow velocity is heavily dependent upon the resiliency of a bow, which is a measure of the ability of the bow to recover from a flexed state when the arrow is drawn back. The stiffness of the bow limbs is also important. The stiffness and stiffness distribution along the length of the limb can affect the pull back force required as well as the velocity of the shot.

The accuracy of a bow is another important characteristic. Accuracy is determined by numerous factors. The limbs of the bow must deflect and return on a consistent basis, and the central portion of the bow, the riser, must be sufficiently rigid to not deflect or twist during aiming or shooting. Vibration damping is another critical performance factor. As the arrow is released, vibrations can be generated which can affect the trajectory of the arrow as it exits the bow.

The weight of the bow limbs and the riser is also important. A lighter bow limb can return faster, resulting in a faster shot. A light weight riser provides for an overall lighter bow weight or allows for more weight to be added to the bow system to improve the stability and balance of the bow.

Lastly, the sound the bow makes while shooting is also important when the bow is use for hunting. A more silent bow reduces the chance that the prey will hear the shot and become startled and run away.

Numerous improvements in bow technology and construction have been patented. An example of a laminated structure is shown in U.S. Pat. No. 2,945,488 (Cravotta, et. al). Examples of changing the cross section of the bow limbs to enhance performance are shown in U.S. Pat. Nos. 4,122,821 (Mamo), 6,105,564 (Suppan) and 6,718,962 (Adcock). Examples of modifying the bow limb by adding grooves and slots for the string are shown in U.S. Pat. Nos. 2,836,165 (Bear), 2,957,470 (Barna) and 5,609,146 (Izuta). An example of a bow with tubular limbs in shown in U.S. Pat. No. 4,338,909 (Plummer).

There are also numerous examples of bow limbs having holes, primarily for the purpose of weight reduction of the limbs. Examples are U.S. Pat. Nos. 4,201,183 (Bodkin), 5,150,699 (Boissevain), 5,503,135 (Bunk), 6,698,413 (Ecklund) and 6,067,974 (Islas). In each of these examples, the holes are formed by removing material from the bow structure post fabrication, which weakens the structure and causes instability.

U.S. Published Patent Application US2004/0084039 A1 discloses a bow with a pair of limbs spaced a distance apart either side of the riser. Each bow limb is comprised of a braided fiber reinforced polymer. Apertures are formed at each end of the limb as a means of attaching the limbs to the riser and the wheel mechanism. There is no connection between the limbs which will result in an unstable performance because each limb can operate independently. U.S. Pat. Nos. 4,644,929 (Peck) and 6,964,271 (Andrews) also describe bow limbs formed of a pair of parallel limb elements.

There also exist numerous examples of improvements to the handle riser of the bow system to reduce the weight. These include holes and openings which are formed in the riser to reduce the weight, and constructing the riser from lightweight metals such as aluminum and magnesium. U.S. Pat. No. 5,335,645 (Simonds, et. al) describes an aluminum riser with recesses machined in the structure to reduce the weight. Examples in the market are the Martin Pro Series or Gold Series of compound bows, or the Samick Masters Series of recurve bows. Other examples are shown in U.S. Pat. Nos. 6,257,220 (McPherson, et. al) and 7,066,165 (Perry).

Examples of bow limbs fabricated of fiber reinforced composites are shown in U.S. Pat. Nos. 5,392,756 and 5,501,208 (Simmonds) and 5,657,739 (Smith). Composite materials have also been used to make the bow riser lighter or for improved vibration damping. Examples include U.S. Pat. Nos. 4,693,230 (Sugouchi), 5,269,284 (Pujos, et. al), 5,845,388 and 6,669,802 (Andrews, et. al), and U.S. Published Patent Application No. US2005/0229912 A1 (Piopel, et. al).

SUMMARY OF THE INVENTION

There exists a continuing need for an improved bow that has the combined features of light weight, improved bending stiffness, improved strength, improved aerodynamics and improved vibration damping. In this regard, the present invention substantially fulfills this need.

The bow system according to the present invention substantially departs from the conventional concepts and designs of the prior art and in doing so provides an apparatus primarily developed for the purpose of maintaining light weight while providing tailored stiffness, greater strength, improved aerodynamics, improved vibration damping, as well as improved appearance.

The present invention relates to a composite structure for a bow system, including both the limbs and riser, where at lest portions of the structure are comprised of multiple continuous tubes, fused together along their facing surfaces to provide one or more internal reinforcing walls, which provides strength and stiffness advantages. In addition, the tubes can be separated at various locations to form apertures or ports between the tubes. The ports are preferably oval or circular in shape, such as to form opposing arches, which provide additional stiffness, strength, aerodynamic and vibration damping benefits.

Another advantage of the invention is vibration damping. Vibrations are damped more effectively with the opposing arch construction. This is because the movement and displacement of the arches absorbs energy which damps vibrations. As the tubular parts deflect, the shape of the ports can change, allowing a relative movement between the portions of the tube either side of the port. This movement absorbs energy which damps vibrations. A quieter bow structure is said to be more accurate.

The ports also provide an aerodynamic advantage by allowing air to pass through the bow. The bow limbs accelerate at a rapid rate when the arrow is released from a full draw. The improved maneuverability of the bow limb will improve arrow velocity.

Finally, there is a very distinguished appearance to a bow made according to the invention. The ports are very visible, and give the tubular part a very light weight look, which is important in bow marketing. The ports can also be painted a different color, to further enhance the signature look of the technology.

There has thus been outlined, rather broadly, the more important features of the invention such that the detailed description thereof that follows may be better understood and in order that the present contribution to the art may be better appreciated. There are, of course, additional features of the invention that will be described hereinafter and which will form the subject matter of the claims attached.

The improved bow of the present invention provides a new and improved bow system of durable and reliable construction, which may be easily and efficiently manufactured at low cost with regard to both materials and labor In addition, the improved bow has improved strength and fatigue resistance, improved vibration damping characteristics, and can provide specific stiffness zones at various locations along the length of the bow.

The apertures or "ports" defined in the bow can improve the aerodynamics of the bow limb, as well as provides a bow having a unique look and improved aesthetics.

DETAILED DESCRIPTION OF THE INVENTION

As described below, the bow system is formed of two or more tubes which are fused together along facing surfaces to form internal, common wall(s). The internal, common walls improve the strength of the bow by acting as a brace to resist compression of the cross section resulting from bending loads.

To form the ports, the facing surfaces of the tubes are kept apart at selected locations during molding, thereby forming openings. On either side of the openings, the tubes are joined together to form the internal wall. These ports are formed without drilling any holes, which provides a strength advantage because no reinforcement fibers in the composite are severed to form the holes.

The resulting structure is found to have superior performance characteristics for several reasons, and can provide performance benefits for both the bow limbs and the bow riser.

For bow limbs, the ports are preferably in the shape of double opposing arches. This allows the structure to deflect, deforming the ports, and return with more resiliency. The ports also allow greater bending flexibility than would traditionally be achieved in a tubular design. The internal wall between the hollow tubes adds strength to resist compressive buckling loads generated from the extreme bending of the bow limbs. The ports allow air to pass through, making the bow limbs more aerodynamic to improve the return velocity of the bow limb when the arrow is released. Finally, the structure can also improve accuracy by providing stability of the bow limb and damping vibrations due to the deformation of the ports.

The performance of the bow riser is improved by the internal wall between the tubes which, adds rigidity and strength. In addition, the ports formed between the tubes can have multiple orientations to achieve different performance benefits. Vibration damping is also improved because the ports can deform, which absorbs energy and damps vibration. This improves the accuracy of the bow system.

Figure 1:
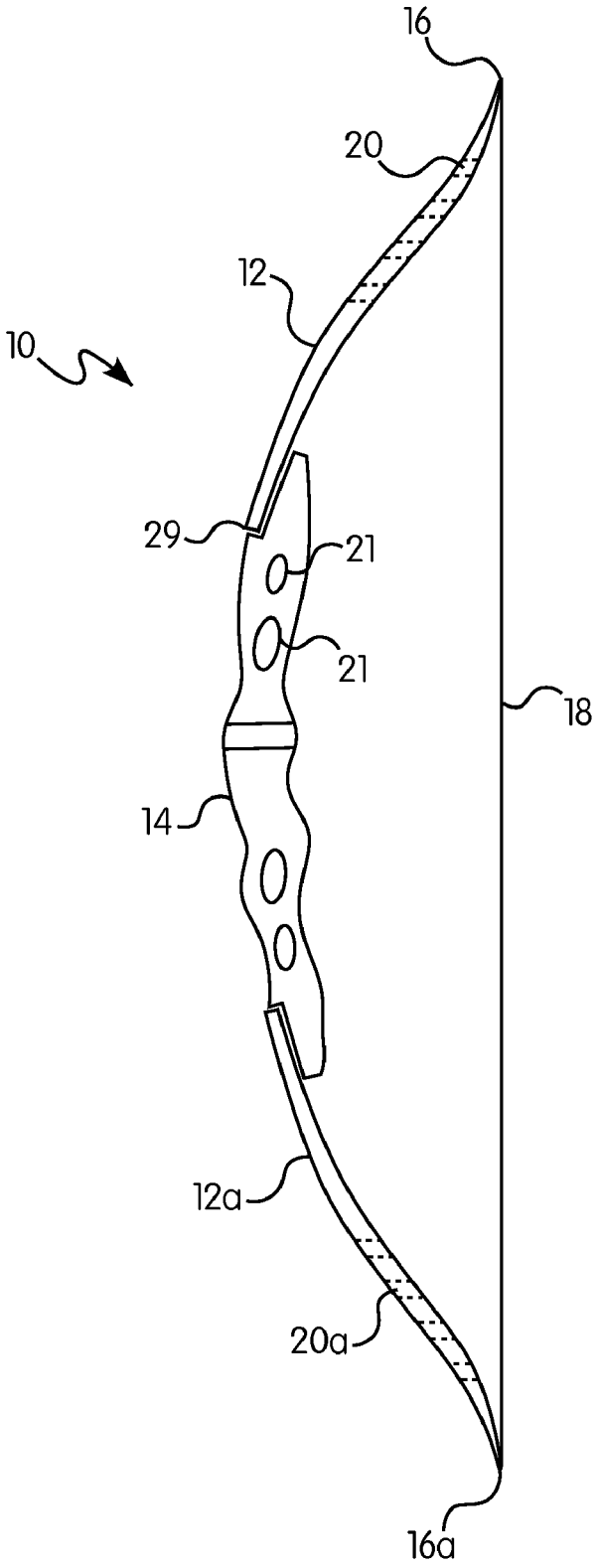
FIG. 1 is a side view of a first embodiment of a bow constructed in accordance with the present invention.

FIG. 1 illustrates a bow, which is referred to generally by the reference numeral 10. The bow 10 includes limb portions 12 and 12*a* that connect to the riser 14. The limb portions 12 and 12*a* have tip portions 16 and 16*a* to which string 18 is connected. Bow limbs 12 and 12*a* may have ports 20 and 20*a* respectively molded into the structure. The bow riser 14 may have ports 21 molded into the structure.

Figure 2:
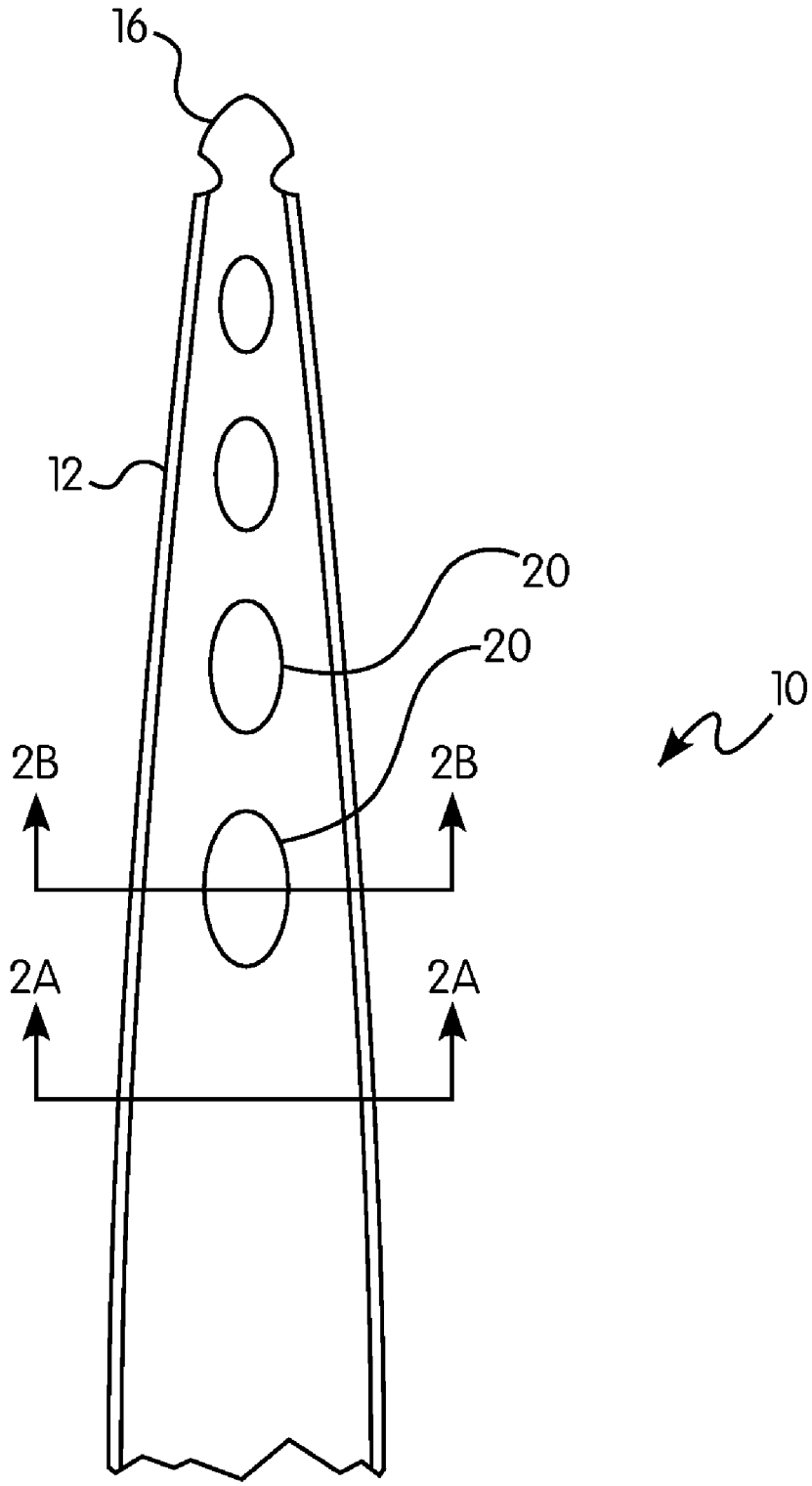
FIG. 2 is a rear view of a first embodiment of a bow limb constructed in accordance with the present invention.

FIG. 2 shows a front view of bow limb 12 showing a preferred embodiment of the invention in which ports 20 extend through bow limb 12, oriented in line and with axes parallel to the direction of travel of the bow limb. The ports 20 may be located along the length of the bow limb 12. Limb 12*a* would typically be identical to limb 12, but may have a different configuration.

Figure 2A:
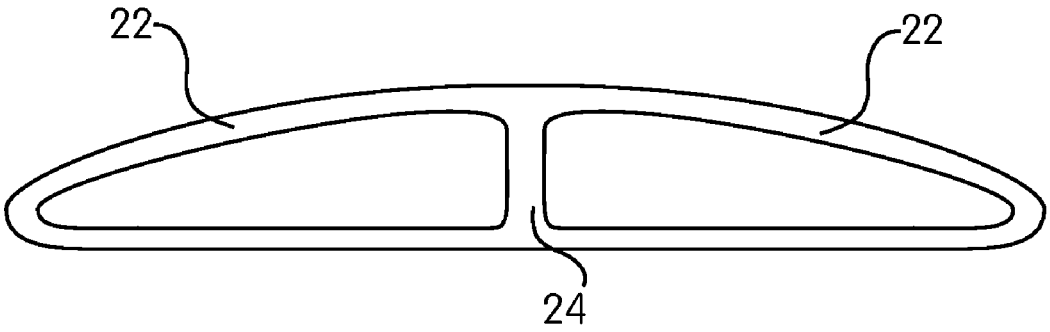
FIG. 2A is a cross sectional view of the bow limb taken along lines 2A-2A of FIG. 2.

FIG. 2A, taken along the lines 2A-2A of FIG. 2, shows the two hollow tubes 22 which form the structure of the shaft in this embodiment. The hollow tubes 22 are joined together to form an internal wall 24. The preferred location of the internal wall 24 is near the central axis of the bow limb. Both of the hollow tubes 22 are preferably about the same size and, when molded together, form a bow limb having a flattened "D" shape cross section.

Figure 2B:
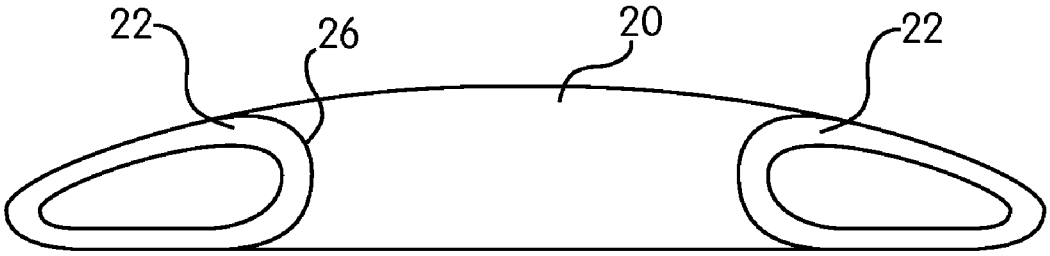
FIG. 2B is a cross sectional view of the bow limb taken along lines 2B-2B of FIG. 2.

FIG. 2B, taken along the lines 2B-2B of FIG. 2, shows that, at the locations of the ports 20, hollow tubes 22 are separated from one another to form the walls defining the periphery of ports 20. It is advisable to have a radius (i.e., rounded edges 26) leading into the port so to reduce the stress concentration and to facilitate the molding process.

Figure 2C:
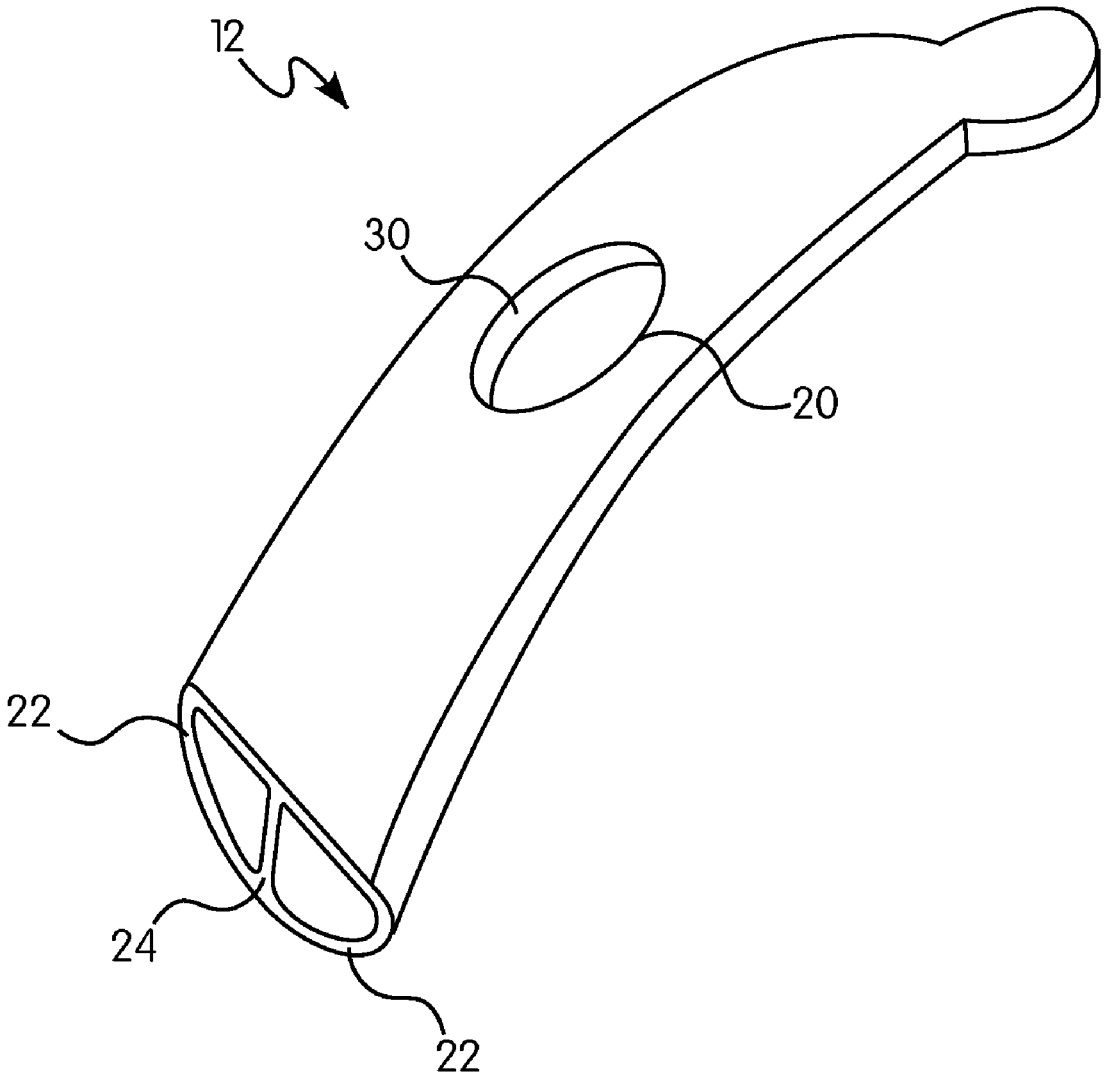
FIG. 2C is an isometric view of a portion of the bow limb shown in FIG. 2.

FIG. 2C is an isometric view of bow limb 12 showing one port in which hollow tubes 22 and internal wall 24 can be clearly seen. Also shown is port 20 formed by curved wall 30 which may have the shape of a portion of a cylinder. Curved wall 30 is formed from the facing walls of hollow tubes 22, where the facing walls have been kept separated to prevent them from fusing together during the molding process.

Figure 3:
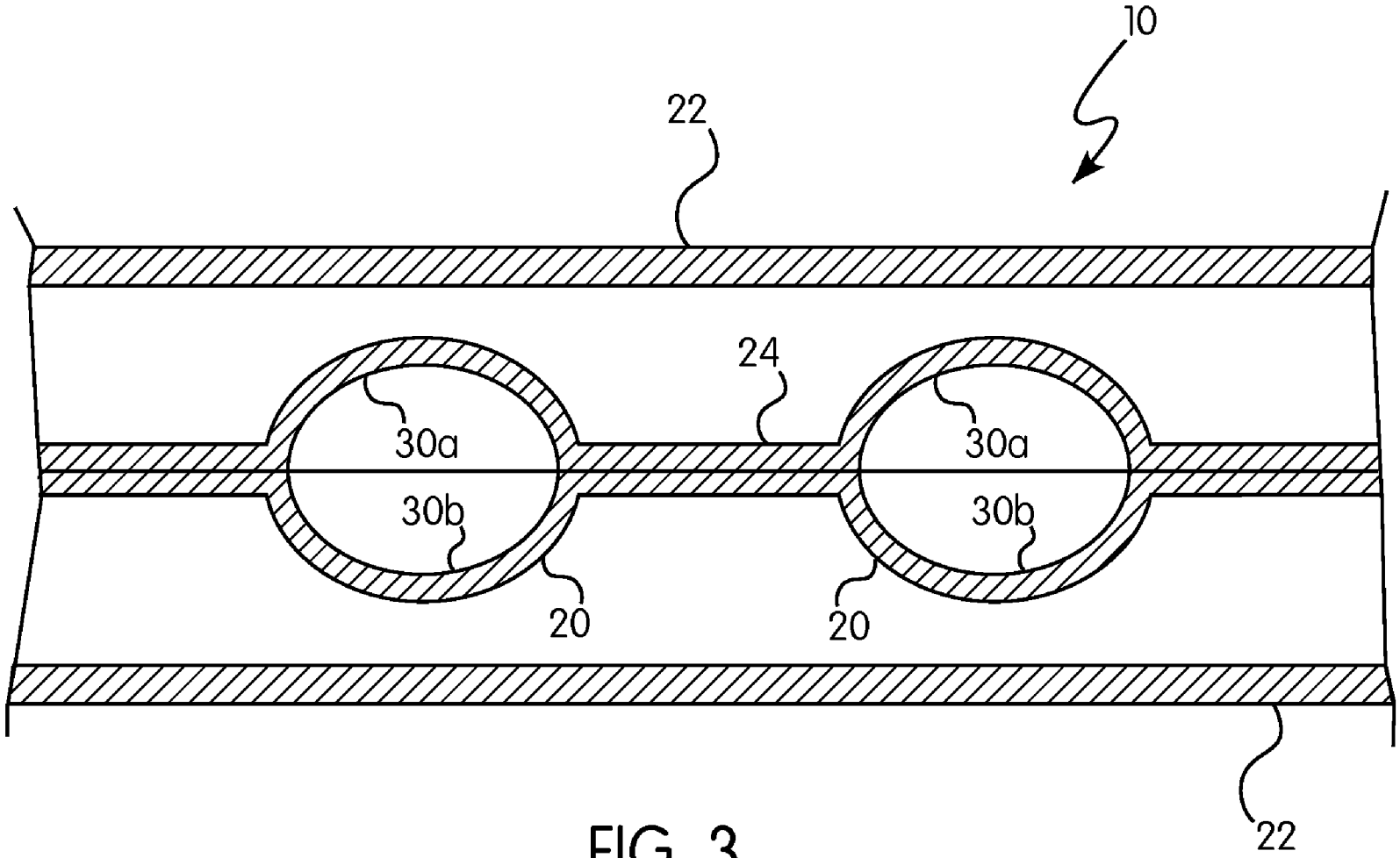
FIG. 3 is a longitudinal sectional view of a portion of the bow limb shown in FIG. 2.

FIG. 3 is a longitudinal section view along the bow limb that shows at locations other than the ports, hollow tubes 22 are positioned side-by-side and are fused together along much of their lengths to form common wall 24 that extends along the centerline of the bow limb, preferably bisecting the bow limb interior. At selected locations where ports 20 are to be formed, facing surfaces 30*a* and 30*b* of tubes 22 are separated during molding to form ports 20 in the shape of double opposing arches which act as geometric supports to allow deformation and return. In addition, internal wall 24 provides structural reinforcement to resist cross section reduction and catastrophic buckling failures.

Figure 4:
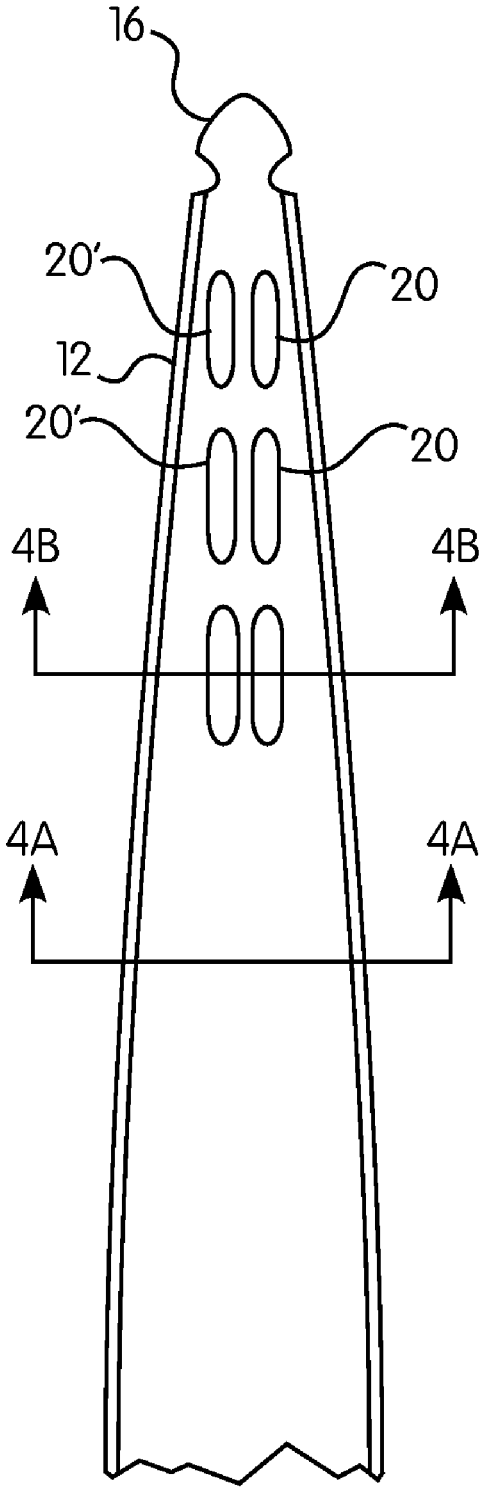
FIG. 4 shows an alternative embodiment of a bow limb constructed in accordance with the present invention.

FIG. 4 shows an alternative embodiment of the bow limb, in which bow limb 12 is designed using a multiple tube construction with allows for ports 20 and ports 20' to be positioned along 2 different rows. In this case, three tubes have been used.

Figure 4A:
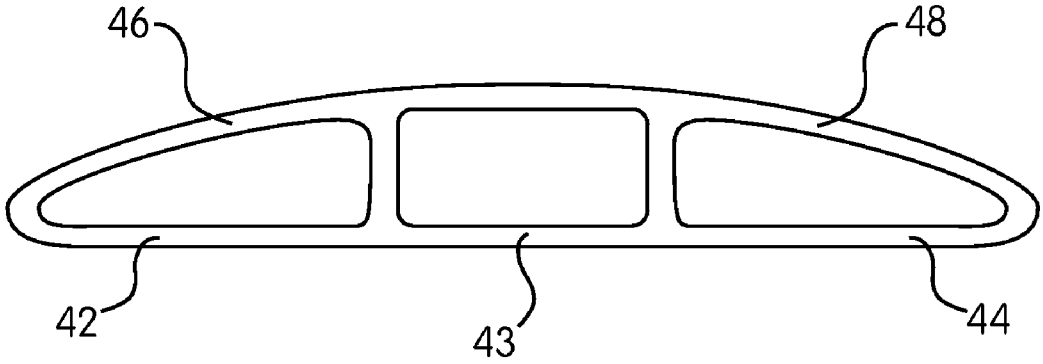
FIG. 4A is a cross sectional view along the lines 4A-4A of FIG. 4.

To form ports in multiple rows, multiple tubes are needed. FIG. 4A shows a cross sectional view of bow limb 12 taken along the lines 4A-4A in FIG. 4. In this example, 3 tubes 42, 43 and 44 are used to create the bow limb which creates two internal walls 46 and 48 therebetween.

Figure 4B:
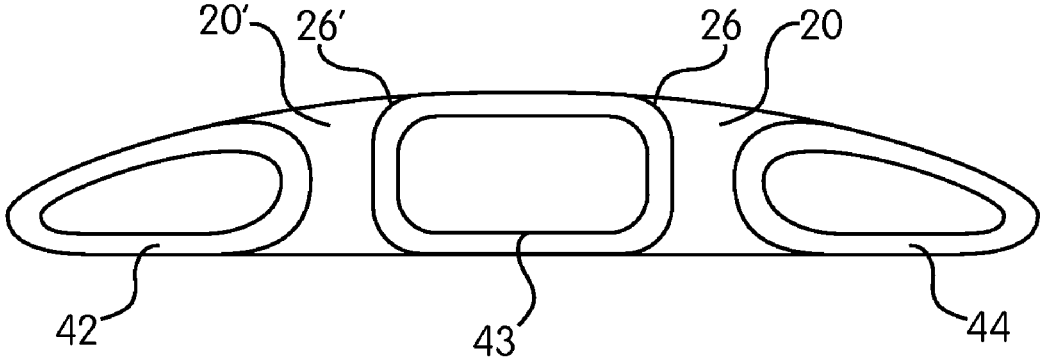
FIG. 4B is a cross sectional view along the lines 4B-4B of FIG. 4.

FIG. 4B, taken along the lines 4B-4B of FIG. 4, shows that ports 20 are firmed when tubes 43 and 44 are separated from one another to form the walls defining such ports. Similarly, to form ports 20', tubes 42 and 43 are separated from one another to form walls defining such ports. Again, it is advisable to have a radiused edge 26 and 26' leading into the port so to reduce the stress concentration and to facilitate the molding process. Note that it is not a requirement that ports 20 and 20' be collocated or aligned along the length of bow limb 12. They may be offset from each other, in which case, the separations of tubes 42 and 43 and tubes 43 and 44 would be at different locations.

Figure 5:
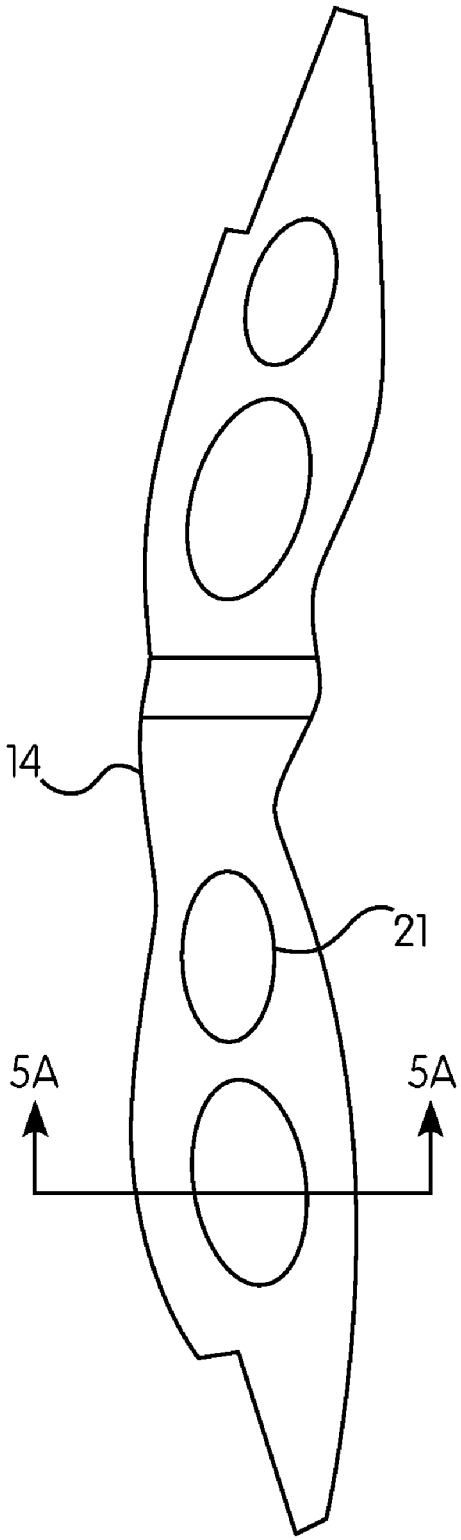
FIG. 5 is a side view of an embodiment of a bow riser constructed in accordance with the present invention.

FIG. 5 shows a side view of the bow riser 14 with ports 21 formed therein. Ports 21 have axes which may be perpendicular to the direction of travel of the arrow or which may be oriented at different angular offsets from the perpendicular. As the bow is drawn to full displacement, the stiffness of the riser can be controlled with the size, location, shape, and number of ports. As the arrow is released, the ports can deform to absorb vibrations. Because no fibers are severed, the bow riser structure retains its stiffness and strength. The bow riser may also be lighter in weight as a result of the formation of the ports.

Figure 5A:
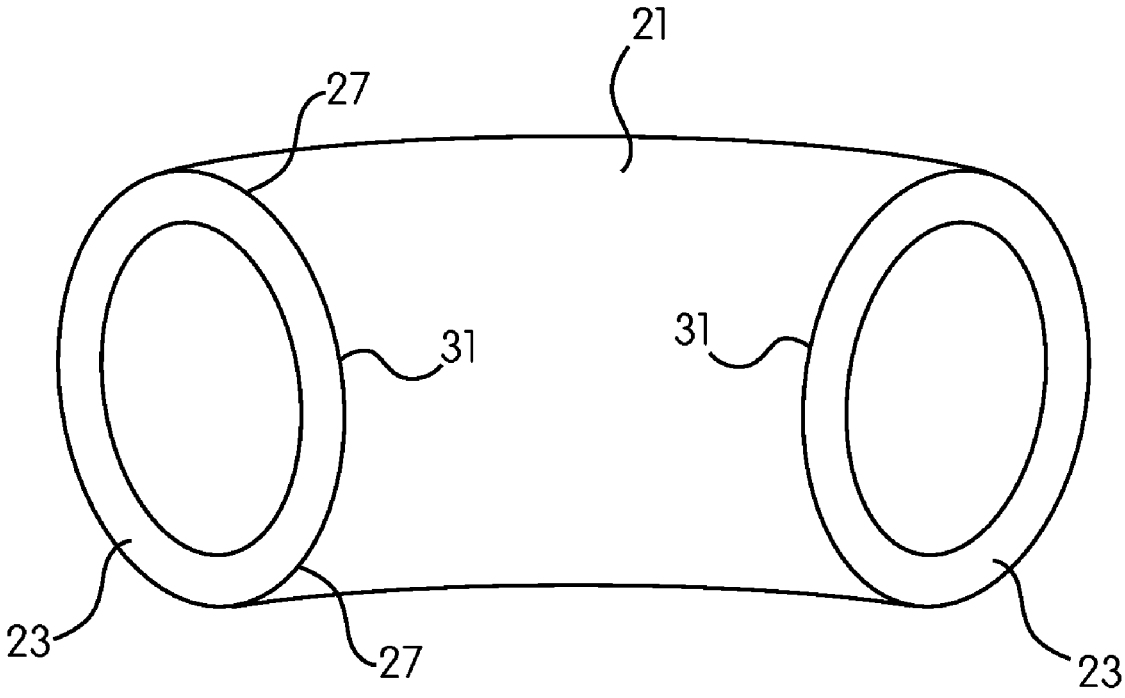
FIG. 5A is cross sectional view of the bow riser taken along lines 5A-5A of FIG. 5.

FIG. 5A is cross sectional view of the bow riser taken along lines 5A-5A of FIG. 5. Here it can be seen the hollow tubes 23 are separated from one another to form walls 31 defining the peripheral walls of port 21. Again it is advisable to have radiused edges 27 leading into port 21 so to reduce the stress concentration and to facilitate the molding process.

Figure 6:
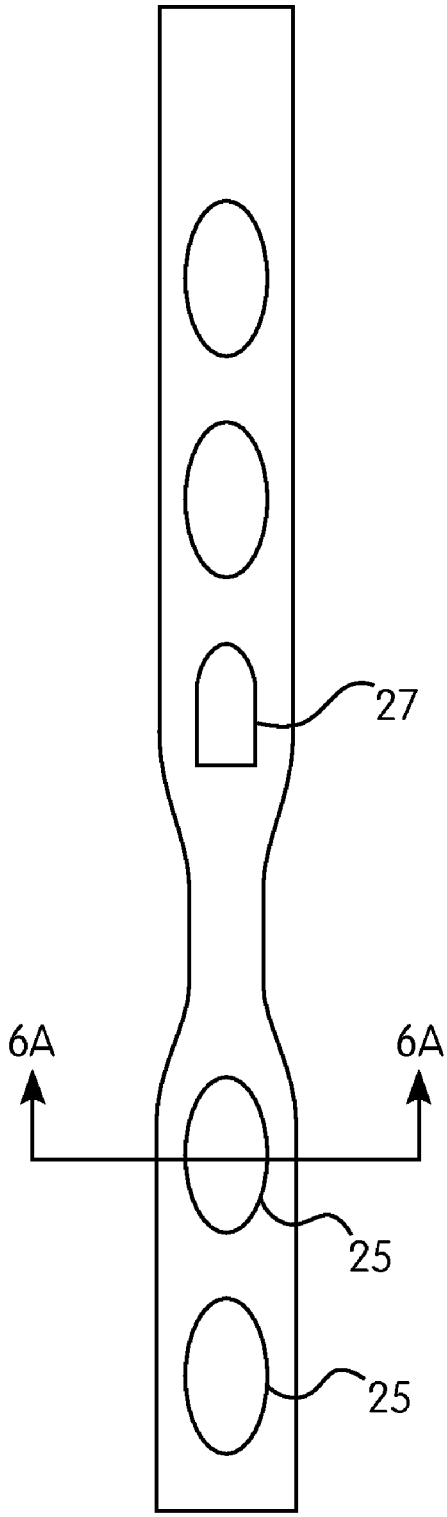
FIG. 6 is a rear view of an embodiment of a bow riser constructed in accordance with the present invention.

FIG. 6 shows a rear view of an alternative embodiment of the bow riser wherein the axes of ports 25 are aligned with the direction of travel of the arrow. In addition, port 27 may be formed to serve as an arrow rest, which allows the arrow to pass through the center of the bow riser. This allows for a secure location to rest the arrow while retaining improved stiffness and strength in this area.

Figure 6A:
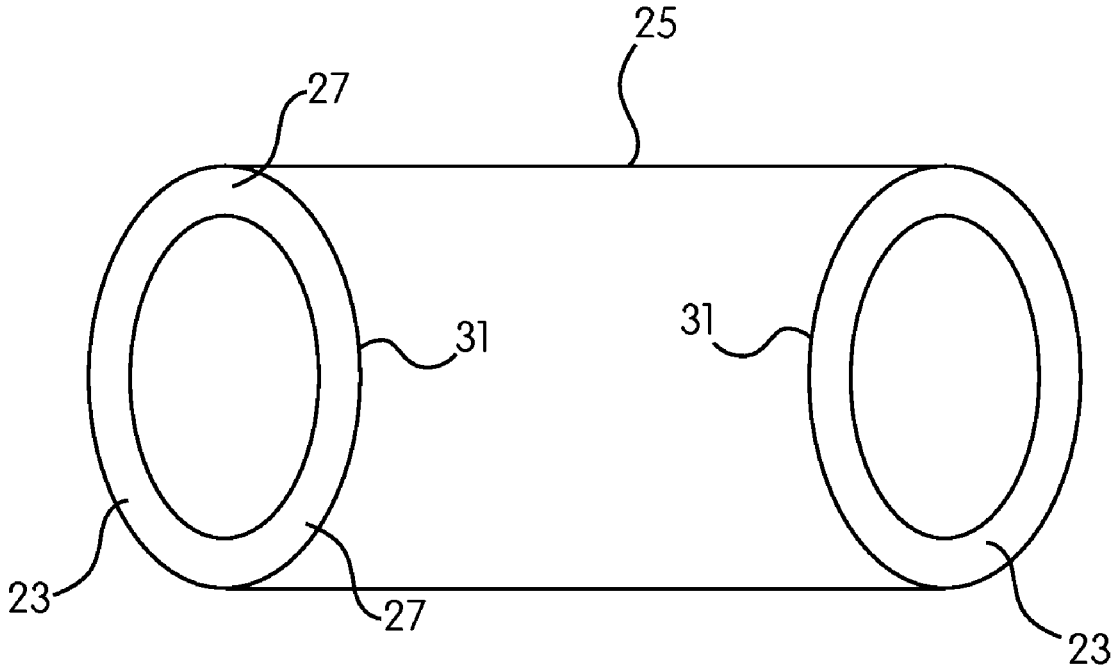
FIG. 6A is cross sectional view of the bow riser taken along lines 6A-6A of FIG. 6.

FIG. 6A shows a cross sectional view of the bow riser 14 taken along the lines 6A-6A of FIG. 6. Here it can be seen that hollow tubes 23 are separated from one another to form the peripheral wall 31 defining ports 21. Again it is advisable to have a radiused edge leading into port 21 to reduce the stress concentration and to facilitate the molding process. Bow risers formed with ports oriented in this manner will have a greater stiffness fore to aft, and be more flexible side to side.

Figure 7:
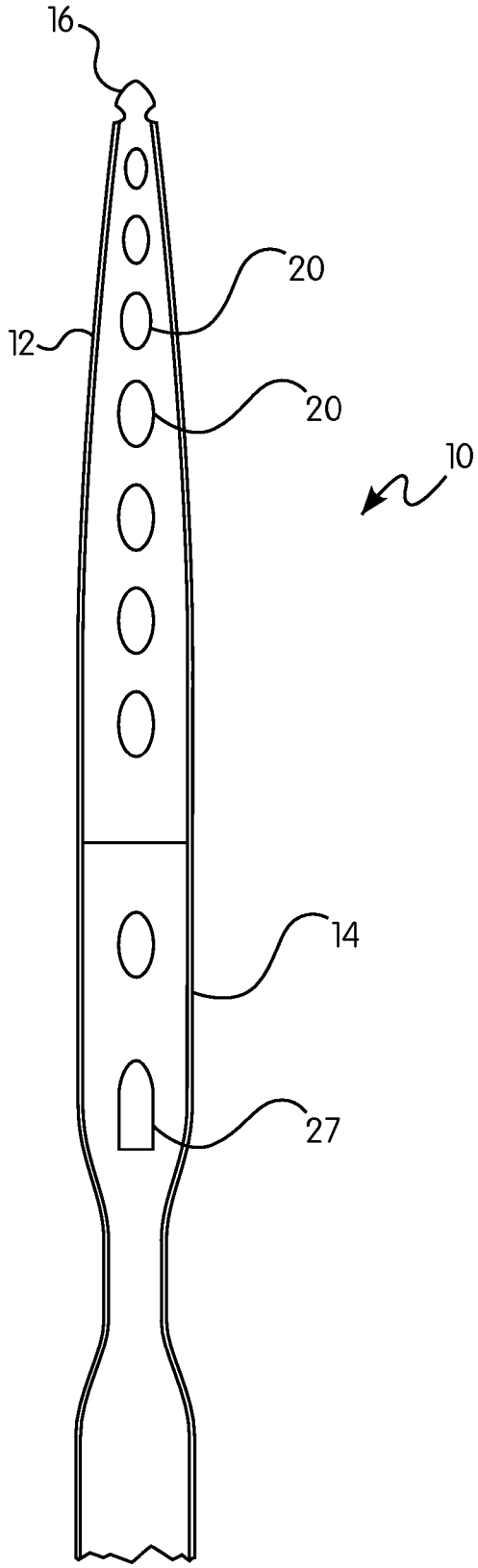
FIG. 7 is a rear view of an alternative embodiment of the invention in which the bow is constructed as a one-piece structure in accordance with the present invention.

FIG. 7 is a rear view of a one piece bow constructed in accordance with an alternative embodiment of the present invention. In this example, two tubes are used continuously from tip 16 of bow limb 12 through riser 14 to the other tip end 16*a* of bow limb 12*a* (not shown) to create a one piece bow system. Ports 20 are located along the bow limb 12 as well as the riser 14. A particular port 27 is positioned in the bow riser 14 to serve as an arrow rest. A conventional arrow rest may also be used.

Figure 11:
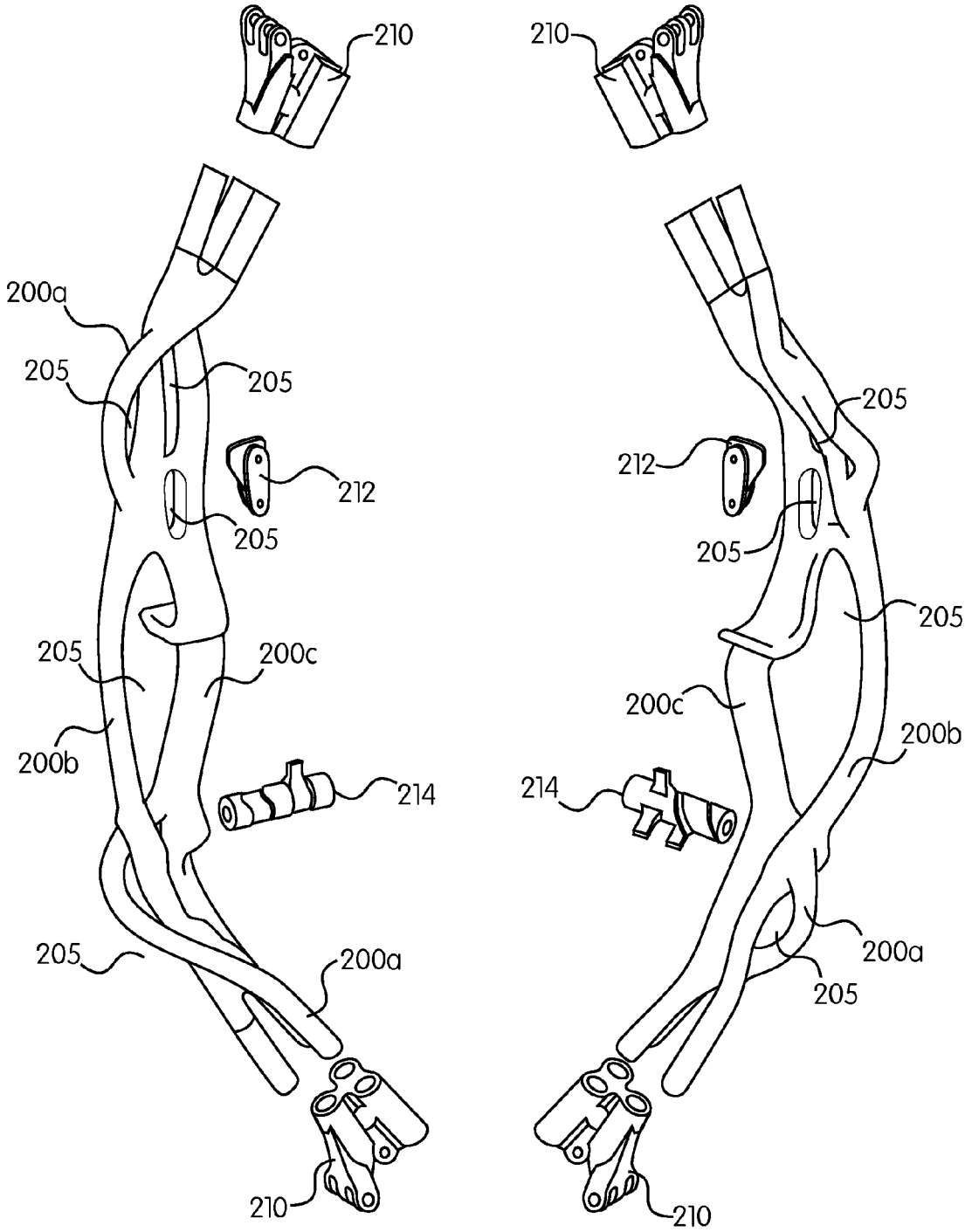
Figure 12A:
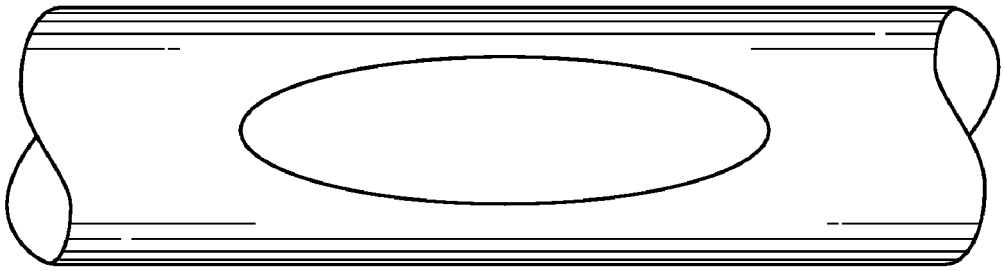
FIGS. 12A-D show various possible shapes of ports.
Figure 12B:
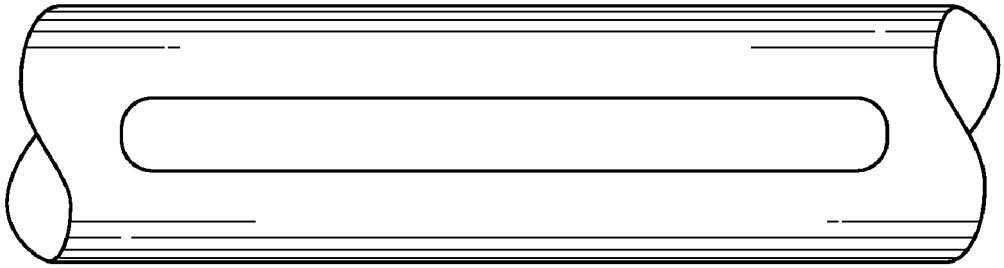
Figure 12C:
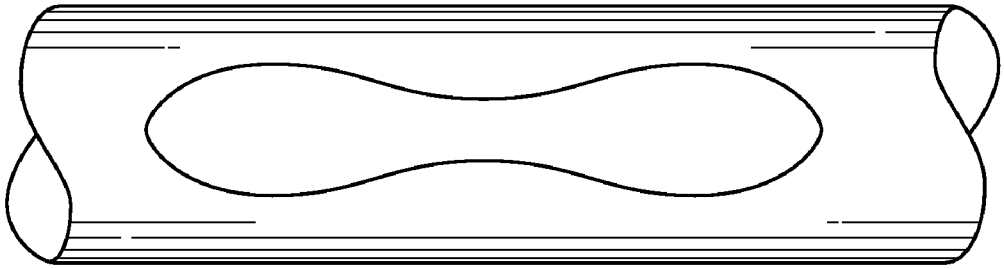
Figure 12D:
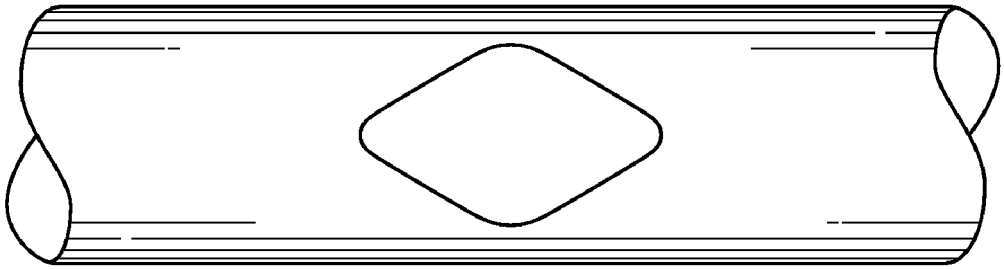

Should it be desired in this embodiment to have ports define in the riser having axes perpendicular to the direction of travel of the arrow, it is possible to construct the riser portion from four tubes and the bow limb portion from two tubes, and fuse them together, possibly with an overlapping single tube, to create the one-piece structure, in the manner shown in FIGS. 11 and 12.

Figure 8:
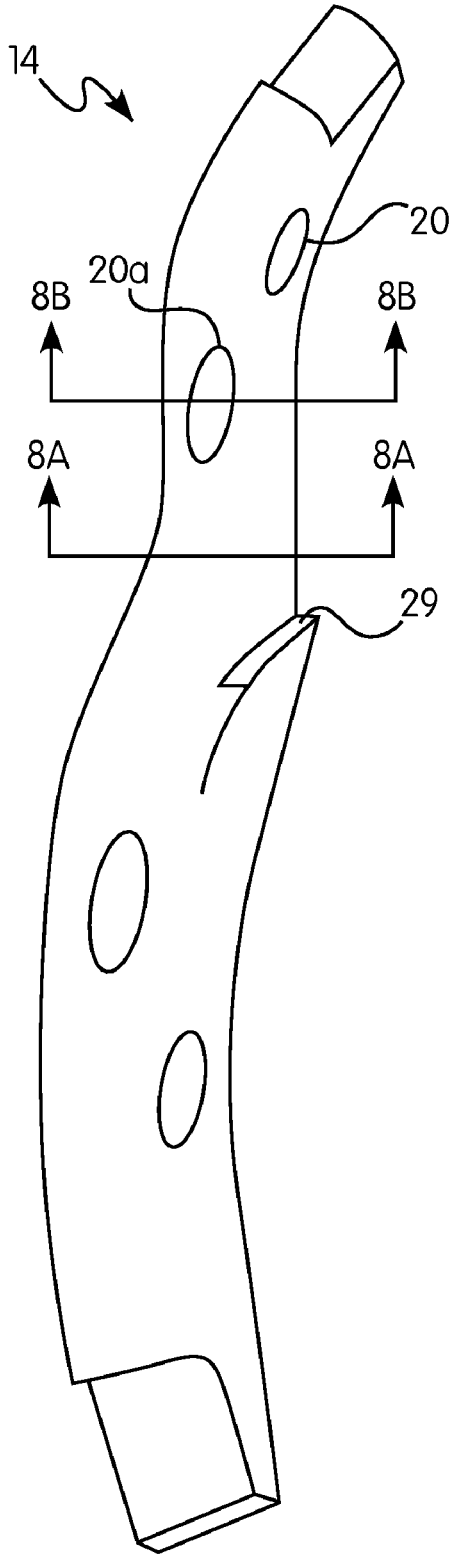
FIG. 8 is an isometric view of a bow riser constructed with a multiple tube design.

FIG. 8 shows an alternative embodiment of bow riser 14 in which utilizes a multiple tube construction which allows for ports 20 and 20*a* to be oriented at different angles. In this particular example, ports 20 have axes oriented perpendicular to the direction of travel of the arrow, and ports 20*a* have axes which are parallel to the direction of travel of the arrow, although any angles may theoretically be used. A bow riser with this type of design would be considered to have the benefits of the ports in two directions. This particular example shows ports 20 and 20*a* alternating. It is also possible arrange the ports in any desirable sequence, orientation and location. In this example a conventional arrow rest 29 is used. It is also possible to form a port to serve as an arrow rest, shown as reference number 29 in FIG. 8.

Figure 8A:
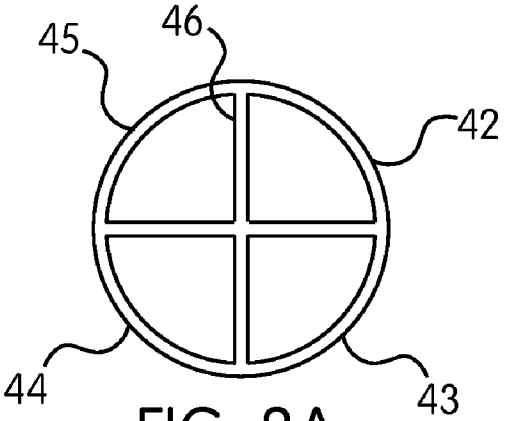
FIG. 8A is a cross section of the bow riser in FIG. 8 taken along lines 8A-8A.

In order to form ports in multiple directions, multiple tubes are needed. In the example of FIG. 8A, 4 tubes 42, 43, 44 and 45 are used to create the tubular part with creates an internal wall 46 in the form of an "X".

Figure 8B:
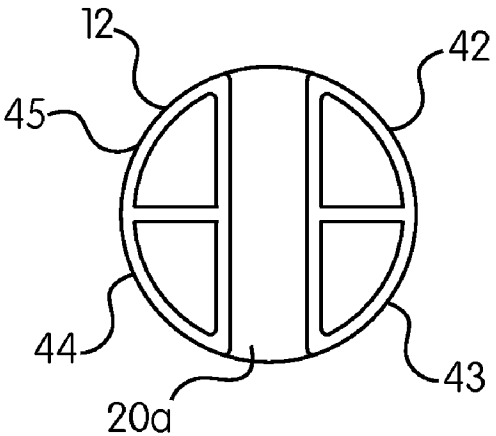
FIG. 8B is a cross section of the bow riser in FIG. 8 taken along lines 8B-8B.

The FIG. 8B cross section is in the region of port 20*a* which has an axis which is parallel to the direction of travel of the arrow. In this example, hollow tubes 42 and 43 have remained fused together, and hollow tubes 44 and 45 have remained fused together, however, tubes 42 and 43 are separated from the tubes 45 and 44 respectively during the molding process to create the port 20*a*.

Figure 8C:
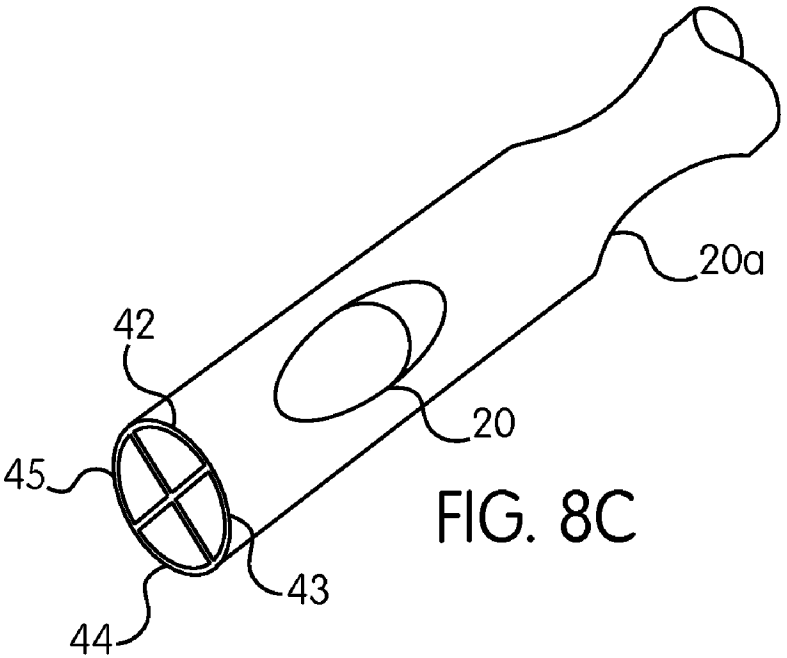
FIG. 8C is an isometric cutaway view of a portion of the bow riser shown in FIG. 8.

FIG. 8C is an isometric view of a cutaway portion of the bow riser 14 of FIG. 8 showing ports 20 with axes oriented perpendicular to the direction of travel of the arrow, and ports 20*a* with axes oriented parallel to the direction of travel of the arrow. As described above in connection with FIGS. 8A and 8B, ports may be formed by separating two tubes from the other two tubes. In this example, to form port 20, hollow tubes 42 and 45 have remained together as well as hollow tubes 43 and 44. To form port 20*a*, hollow tubes 42 and 43 have remained together as well as hollow tubes 44 and 45.

Molding the parts using multiple tubes allows greater design options. For example, separating the hollow tubes at selected axial locations along the bow in order to mold large oval shaped openings between the tubes, allows the characteristics of the bow to be varied as desired.

Figure 9:
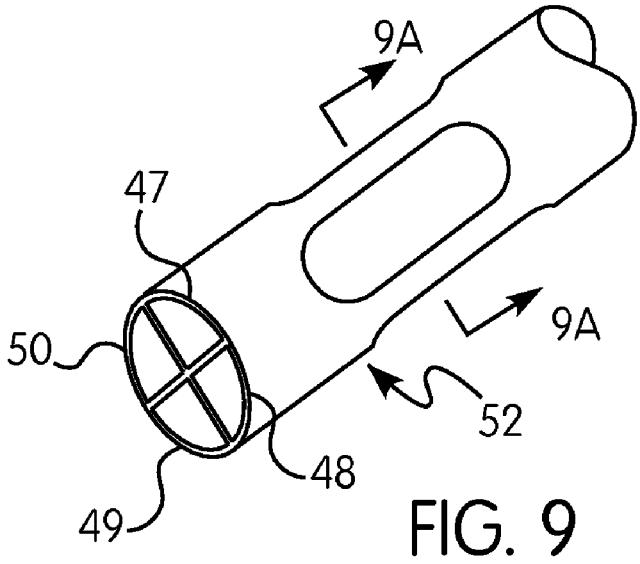
FIG. 9 is an isometric cutaway view of an alternate embodiment of a bow riser made with a multiple tube construction having multiple, co-located ports.

FIG. 9 is an isometric cutaway view of a four tube structure 52 with ports for all tubes located in the same location. In this example, hollow tubes 47, 48, 49, and 50 are all separated in the same location to form four ports 51 there between.

Figure 9A:
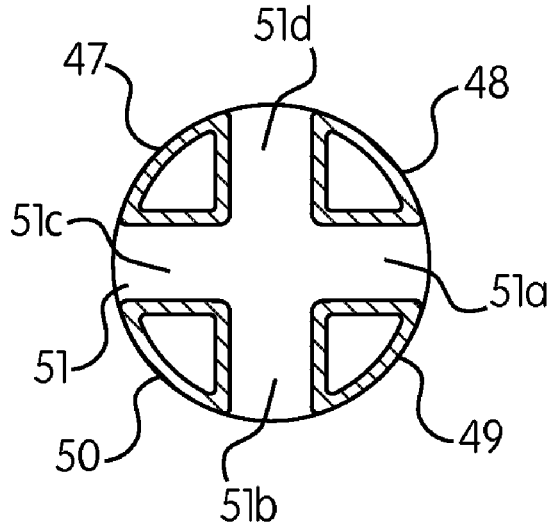
FIG. 9A is a cross sectional view along the lines 9A-9A of FIG. 9.

FIG. 9A is a cross sectional view of tube structure 52 in FIG. 9 taken along the lines 9A-9A. Here it can be seen that because all hollow tubes are separated at the same location, a port 51 having four openings 51*a-d* is formed. This particular embodiment would provide more flexibility and resiliency in both the perpendicular and parallel directions with respect to the direction of travel of the arrow.

In a multiple tube design, there can be any number of ports and orientations of ports depending on the number of hollow tubes used and how many are separated to form these ports. The invention is not meant to be limited to designs using only two or four tubes. For example, with a 3 tube design, the axis of the port would not necessarily have to pass through the center of the bow riser, but would instead be offset to one side as shown in FIG. 4.

Figure 10:
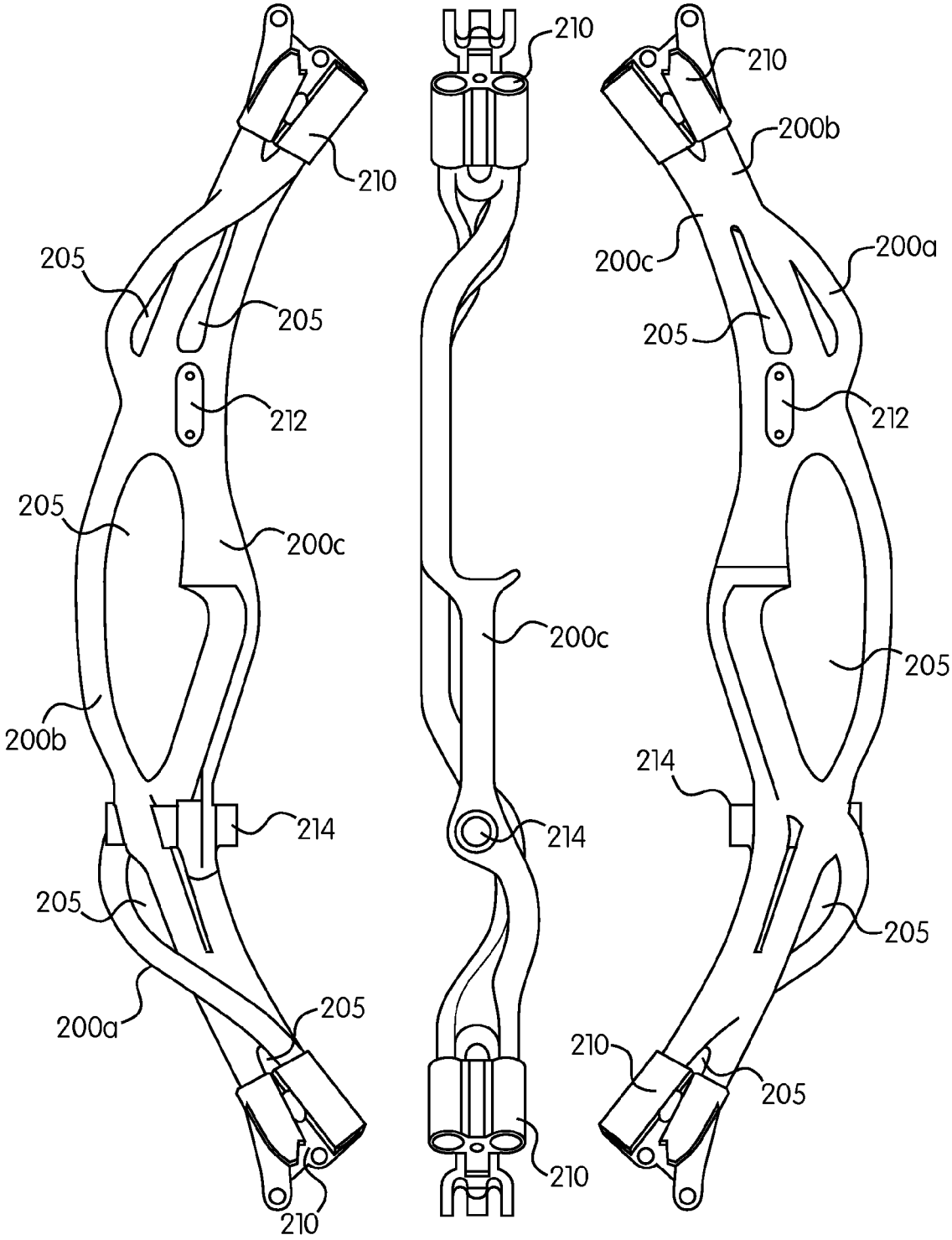
FIGS. 10 and 11 show various views of an embodiment of a bow riser constructed in accordance with the invention, in which three tubes are used which are fused together at various points along their lengths to create a riser with irregularly-shaped ports.

FIG. 10 shows an example of a multiple tube design for a riser having three hollow tubes 200*a*, 200*b* and 200*c*, and irregularly-shaped ports 205 and port orientations. In this design, tubes 200*a-c* are not restricted to being disposed in a single plane or with their longitudinal axes oriented parallel to each other. In this design, the tubes lie in varying planes and contact the other tubes at various points along their surfaces, defining irregular ports 205 between the tubes and short, irregularly-shaped internal walls at the attachment points of the tubes.

Also shown in FIG. 10 are attachment members 210 which may be used to attach bow limbs (not shown) to the riser portion of the bow. In this case, the attachment members may be composed of a composite material, or some other material, such as metal or ceramic, and may be either co-molded with the riser or attached later via a mechanical means, such as a with a screw or an adhesive. In the co-molding process, the pre-formed part is placed into the mold with the uncured tubes and becomes attached as the composite material of which the tubes are composed cures. If the attachment members are to be composed of a composite material, they may be cured at the same time as the riser, making the riser and the attachment members appear as a single structure.

Also shown in FIGS. 10 and 11 are insert members 212 and 214 which are disposed in ports. In this case, insert member 212 is an attachment device for various accessories that may be used with the bow, and insert 214 is a weight to provide damping and to reduce vibrational movement of the bow. The inserts may serve any function, for example, elastomeric inserts may be provided in various ports to provide vibrational damping.

A riser having tubes arranged in this manner offers several advantages. The tubes can be arranged so that the centroid of all tubes is located in a desired location to control the bending of the riser when the bow is flexed. This results in a more accurate shot. Another advantage of this arrangement of the tubes is to vary the stiffness of the riser in all directions by varying the tube diameters, positions, and contact locations with other tubes. The tubes also look like branches of trees and bushes, to give the bow an improved camouflage look.

FIGS. 12A-D illustrate some examples of the variety of shapes possible for the ports. Depending on the performance required of the structure at a particular location, more decorative port shapes can also be used. The invention is not meant to be limited to only those ports shown, but can utilize ports of any shape.

In all orientations, the quantity, size, and spacing of the ports can vary according to the performance desired. In addition, the internal wall assists in resisting the buckling of the tubular construction from the extreme bending of the bow limbs, especially ion the three tube design, which creates two internal walls.

The preferred embodiments of the present invention use multiple continuous composite tubes which are separated to form apertures in the form of double opposing arches at various locations in the bow.

When considering tubular constructions for bow limbs, there exist other challenges. Because of the severe bending of the bow limbs when shooting an arrow, high compression buckling loads exist. A single tubular structure cannot withstand these compressive stresses and will buckle under the stress. However, the internal wall(s) created by the present invention adds sufficient strength to resist these stresses.

Tubular structures can also be too rigid due to their geometry, and therefore difficult to draw the arrow to the maximum position. Adding ports along the length of the bow limb increases flexibility in key areas for enhanced performance.

The ported tubular structure also is more stable. The ported bow limb acts like parallel limbs with bracing in between to increase the torsional stiffness and stability.

Finally, the ported bow limb allows for air to pass through the ports which allows the bow limbs to return with more velocity and therefore greater arrow velocity.

The invention allows the bow to be custom tuned during the manufacturing process in terms of its stiffness and resiliency by varying, in addition to the material used and the geometry of the bow itself, the size, number, orientation and spacing of the ports in the bow.

The bow is preferably constructed of sheet of unidirectional reinforcement fibers, such as carbon fibers, embedded in an uncured resin such as epoxy. The resin cures when heat is applied. This material is often referred to as "prepreg". The prepreg tubes used to make the bow, or its various parts, may be formed by rolling sheets of prepreg into a tube. Alternately, the prepreg tubes may be formed of reinforcement fibers and a thermoplastic material, using a technique similar to that disclosed in U.S. Pat. No. 5,176,868.

The fiber reinforcement materials may be composed of, for example, carbon, fiberglass, aramid or boron, or any other such material known in the art. The resin may be, for example, epoxy, polyester, vinyl ester, nylon, polyamide resins, ABS and PBT, or any other material known in the art for this purpose.

When molding the same bow limb using two prepreg tubes, each tube should be approximately half the size of the cross section of the bow limb, with three, each should be about one third of the size of a cross section of the bow, etc. A polymer bladder is inserted into the middle of each prepreg tube and is used to generate internal pressure to consolidate the plies upon the application of heat. The mold packing process consists of taking each prepreg tube and internal bladder and positioning them into a mold cavity. An air fitting is then attached to the bladder. The process is repeated for each tube depending on how many are used. Care should be taken for the position of each tube so that the internal wall formed between the tubes is oriented properly, and that pins can be inserted between the tubes to separate the tubes in selected locations to form the ports during pressurization. The pins are secured into portions of the mold and are easily removed.

The mold is designed with a cavity that will form the external shape of the molded part. The mold is pressed closed in a heated platen press and air pressure for each tube is applied simultaneously to retain the size and position of each tube and the wall which is formed therebetween. Simultaneously, the tubes will form around the pins to form the ports. As the temperature rises in the mold, the viscosity of the epoxy resin decreases and the tubes expand, pressing against each other until expansion is complete and the epoxy resin is cross linked and cured. The mold is then opened, the pins and bladders removed, and the part is removed from the mold.

If multiple tubes are used, they may be formed of a single, long tube which has been reversed upon itself. The additional tubes could also be a separate tube construction using internal air pressure for consolidation or have an expanding internal foam core to provide such pressure.

The orientation of the wall in the bow riser can be positioned to take advantage of the anisotropy it offers. If more bending flexibility is desired, the wall can be positioned along the neutral axis of bending. If greater stiffness is needed, then the wall can be positioned like an "I Beam" at 90 degrees to the neutral axis to greatly improve the bending stiffness.

Molding in of apertures, or ports, at selected locations results in a double opposing arch construction, depending upon the actual shape of the port. The ports, which are preferably oval in shape, create two opposing arches which allow the tubular part to deflect, while retaining the cross sectional shape of the tube because of the three dimensional wall structure provided by the port. For example, a ported double tube structure has a combination of exterior walls, which are continuous and form the majority of the structure, and ported walls, which are oriented at an angle to the exterior walls, which provide strut like reinforcement to the tubular structure. The cylindrical walls of the ports prevent the cross section of the tube from collapsing, which significantly improves the strength of the structure.

The stiffness and resiliency of the ported double tube structure can be adjusted to be greater or less than a standard single hollow tube. This is because of the option of orienting the internal wall between the tubes as well as the size, shape, angle and location of the ports. The ports can be stiff if desired, or resilient allowing more deflection and recovery, or can be designed using different materials or a lay-up of different fiber angles to produce the desired performance characteristics of the structure.

The structure can be further refined by using more than two tubes in a configuration where a facing side of each of the three tubes is fused to a facing side of the other two tubes, forming a "Y" shaped internal reinforcing wall. This type of three tube design also allows for apertures to occur in 120 degree offsets, providing specific stiffness tailoring along those directions. As shown in FIG. 9, using four tubes provides the possibility of having apertures at ninety degree angles to each other and alternately located along the length of the tubular part to achieve unique performance and aesthetic levels. Another option is to locate the multiple ports in the same location to achieve more of an open truss design.

In other embodiments, the bow may be formed from one or more pre-formed portions which are fused with a portion having a multiple tube design. For example, the riser portion may be pre-molded or pre-formed. The riser could then be co-molded with the limb portions or, alternatively, have the limb portions attached after molding using a conventional method of attachment.

Another option is to combine a single tube with a multiple tube composite design. In this example, the single composite tube can be a portion of the bow and co-molded with the multiple tubes to produce a lighter weight alternative to a 100% multiple tube construction. The single tube could also be composed of a composite material, or may be composed of an alternative material, such as metal, wood or plastic.

In this example, the composite single tube can be a portion of the bow riser and fused or co-molded with the multiple prepreg tubes which form the bow limbs. This can produce a lighter weight structure that can still achieve the performance and aesthetic requirements of the product.

Figure 13:
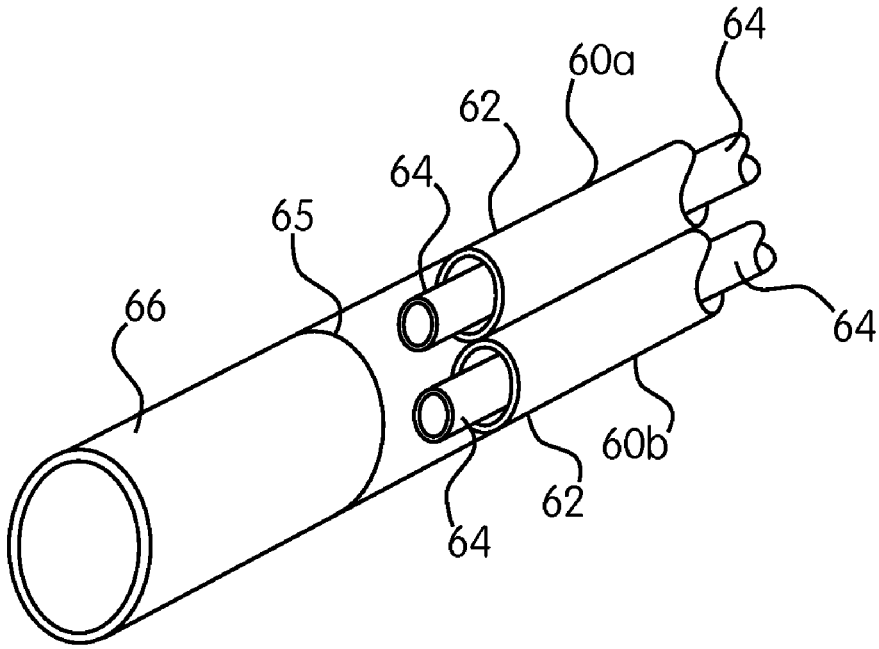
FIGS. 13 and 14 are perspective views illustrating a process for forming a frame member having a multiple tube construction to a member having a single tube construction.
Figure 14:
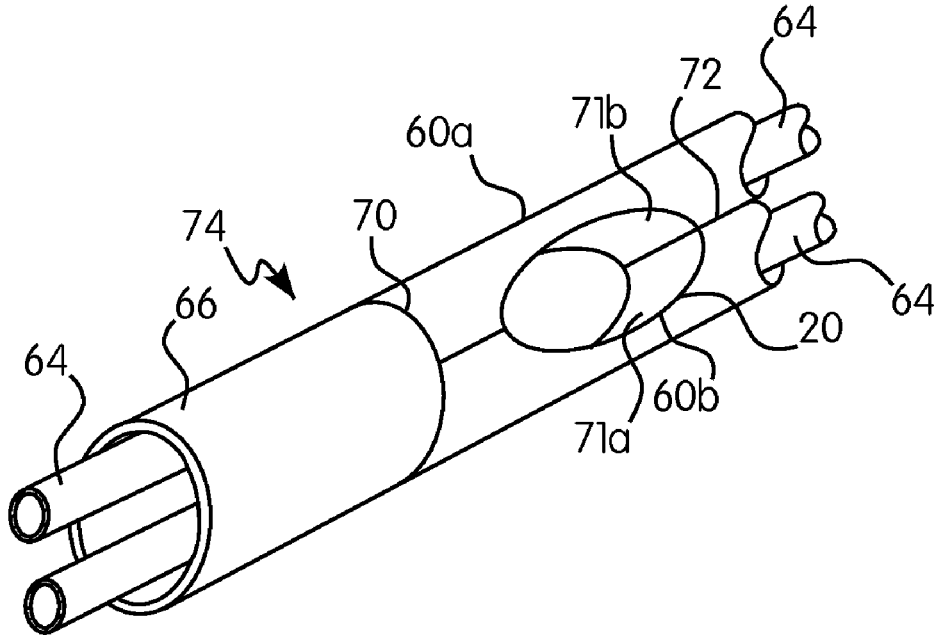

Referring to FIGS. 13-14, to make this construction, the forward ends 62 of a pair of prepreg tubes 60*a*, 60*b*, each having an inflatable bladder 64, are inserted into one end 65 of a composite single tube 66. The structure is then placed inside a mold, which should be shaped, on either side of the juncture 70 of the prepreg tubes 60*a*, 60*b* and the composite single tube 66, such that the outside surface of the unit is continuous. A pin or mold member (not shown) can be placed between the prepreg tubes 60*a*, 60*b* where a port 20 is to be formed. The mold is then closed and heated, as the bladders 64 are inflated, so that the prepreg tubes assume the shape of the mold, the mold member keeping the facing walls 71*a*, 71*b* apart so as to form the port 20. As shown, the tubes 60*a*, 60*b* will form a common wall at seam 72. After the prepreg tubes have cured, frame member 74 is removed from the mold, and the mold member or pin is removed, leaving port 20. In this embodiment, seam 70 between the composite portions 60*a*, 60*b* of frame member 74 and composite single tube portion 66 should be flush.

The tube portion 66 may also be made of metal to produce a less expensive product than using 100% composite materials.

Yet another option is to construct a double opposing arch structure using 100% metal materials. The preferred method to produce this structure is to start with a metal tube with a "D" shaped cross section. The tube can then be formed with a half arch bend along a portion of its length. A similar operation can be done with another metal tube. The two tube halves can then be attached by fixing the flat sides of the D shaped cross section so that the two half arches oppose each other. The tubes can be welded or bonded together resulting in a structure with an internal reinforcing wall and a double opposing arch shaped aperture.

An alternative method to produce a multiple tube structure out of metal is to start with a metal tube such as aluminum, titanium, steel, or magnesium for example, and deform the tube in local areas to create dimples or craters in the surface of the tube on opposing sides. The centers of these dimples can be removed leaving a circular aperture through the tube. A tubular section can then be positioned through these circular apertures and fixed to the edges of this dimple area of the primary tube using a welding process to create the 3D structure. The result will be a structure with the primary tube being a single hollow tube with other single hollow tubes attached in a transverse manner internal to the primary tube.

There are unlimited combinations of options when considering a double opposing arch structure. The ports can vary by shape, size, location, orientation and quantity. The ports can be used to enhance stiffness, resilience, strength, control, aerodynamics and aesthetics. For example in a low stress region, the size of the port can be very large to maximize its effect and appearance. If more deflection or resilience is desired, the shape of the aperture can be very long and narrow to allow more flexibility. The ports may also use designer shapes to give the product a stronger appeal.

If more vibration damping is desired, the ports can be oriented and shaped at a particular angle, and constructed using fibers such as aramid or liquid crystal polymer. As the port deforms as a result of bending deflection, its return to shape can be controlled with various viscoelastic materials which will increase vibration damping. Another way to increase vibration damping is to insert an elastomeric material inside the port.

Figure 15:
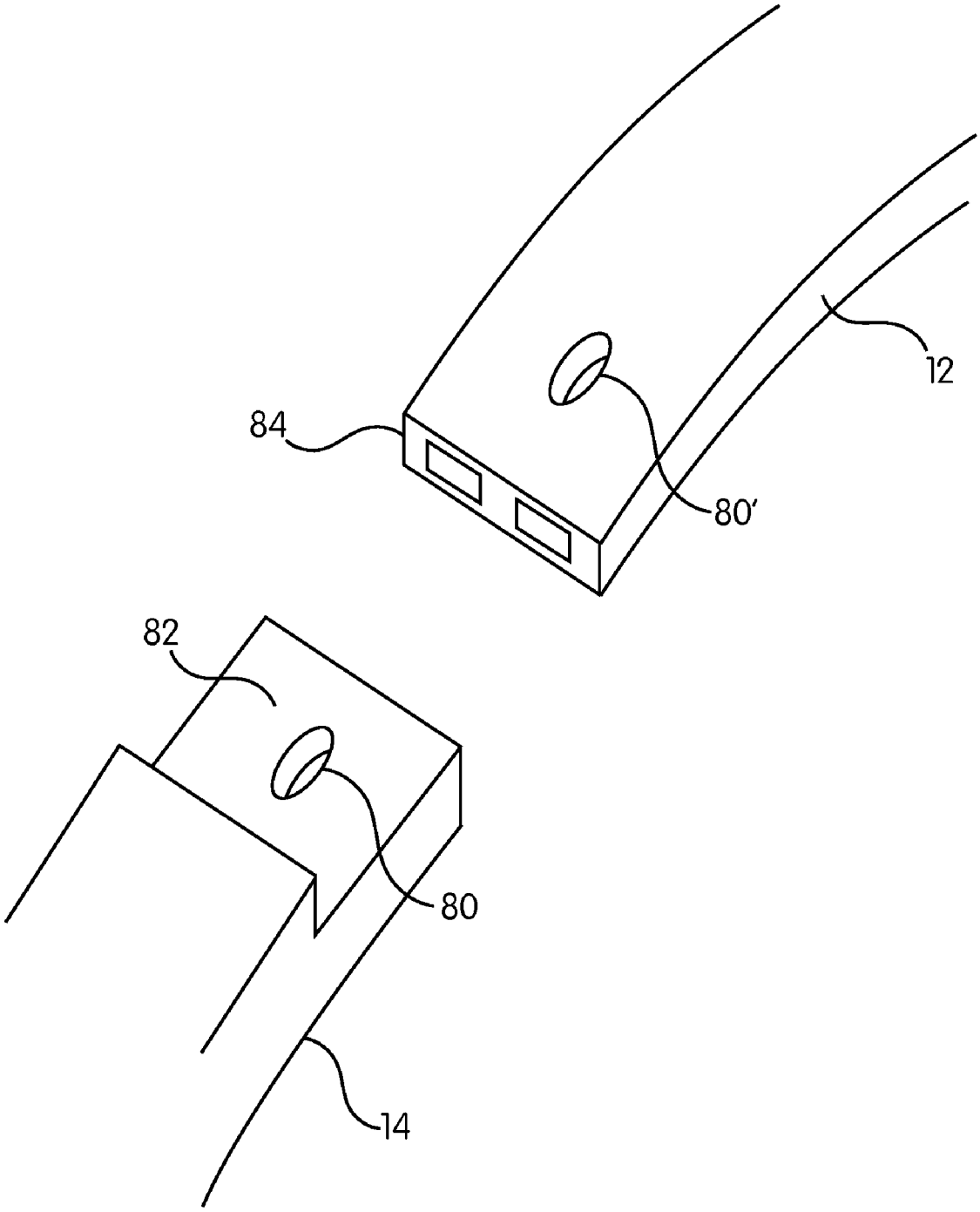
FIG. 15 shows a means of attaching a bow limb and riser of the present invention.

Another advantage of the invention could be to facilitate the attachment of the bow limb to the bow riser. FIG. 15 illustrates a bow riser 14 with a port 80 located on a recessed surface 82. The bow limb 12 has a corresponding port 80' which lines up with port 80 when the bow limb end 84 is placed on the recessed area 82. A fastening means connects the bow limb 12 to the riser 14 through the ports 80 and 80'.

Figure 16:
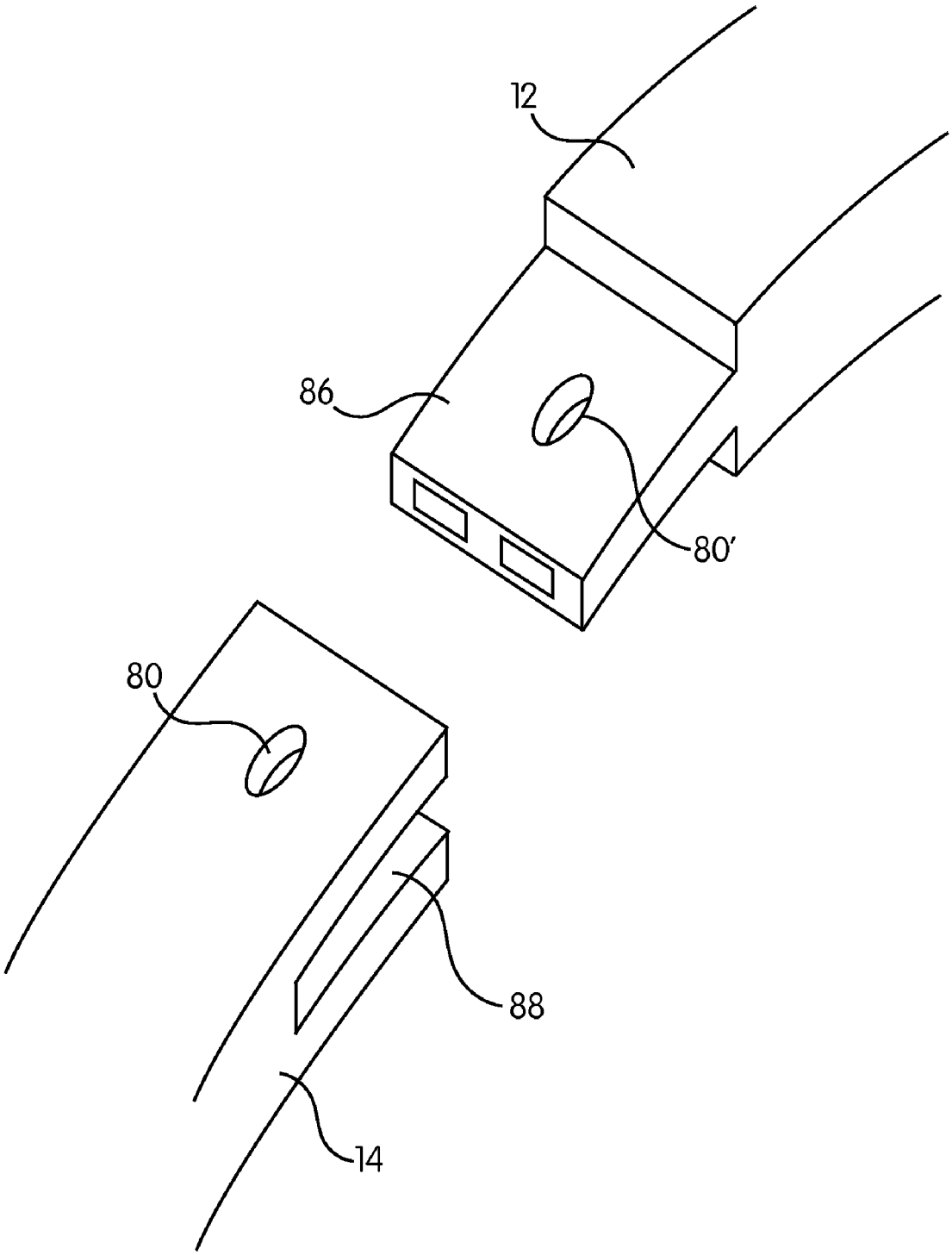
FIG. 16 shows an alternative means of attaching a bow limb and riser of the present invention.

The multiple tube design can also facilitate the attachment of the bow limbs to the riser, the attachment of accessories or the attachment of a wheel and pulley system for a compound bow. FIG. 16 shows an alternative design where the riser 14 has a slot 88 formed into the end of the structure. The upper and lower legs which form the slot 88 have a pair of aligned ports, one of which 80 is shown in FIG. 16. Bow limb 12 has an end 86 with a reduced thickness to fit into the slot 88 of bow riser 14. Once inserted, a fastening means, such as a pin, connects bow limb 12 to bow riser 14 through the ports 80 and 80'. The bow limbs may also be attached to the riser using an adhesive, or a combination of a pin and an adhesive. The ports used for attachment purposes may be constructed in the same manner as discussed previously for structural and performance-enhancing ports.

Figure 17:
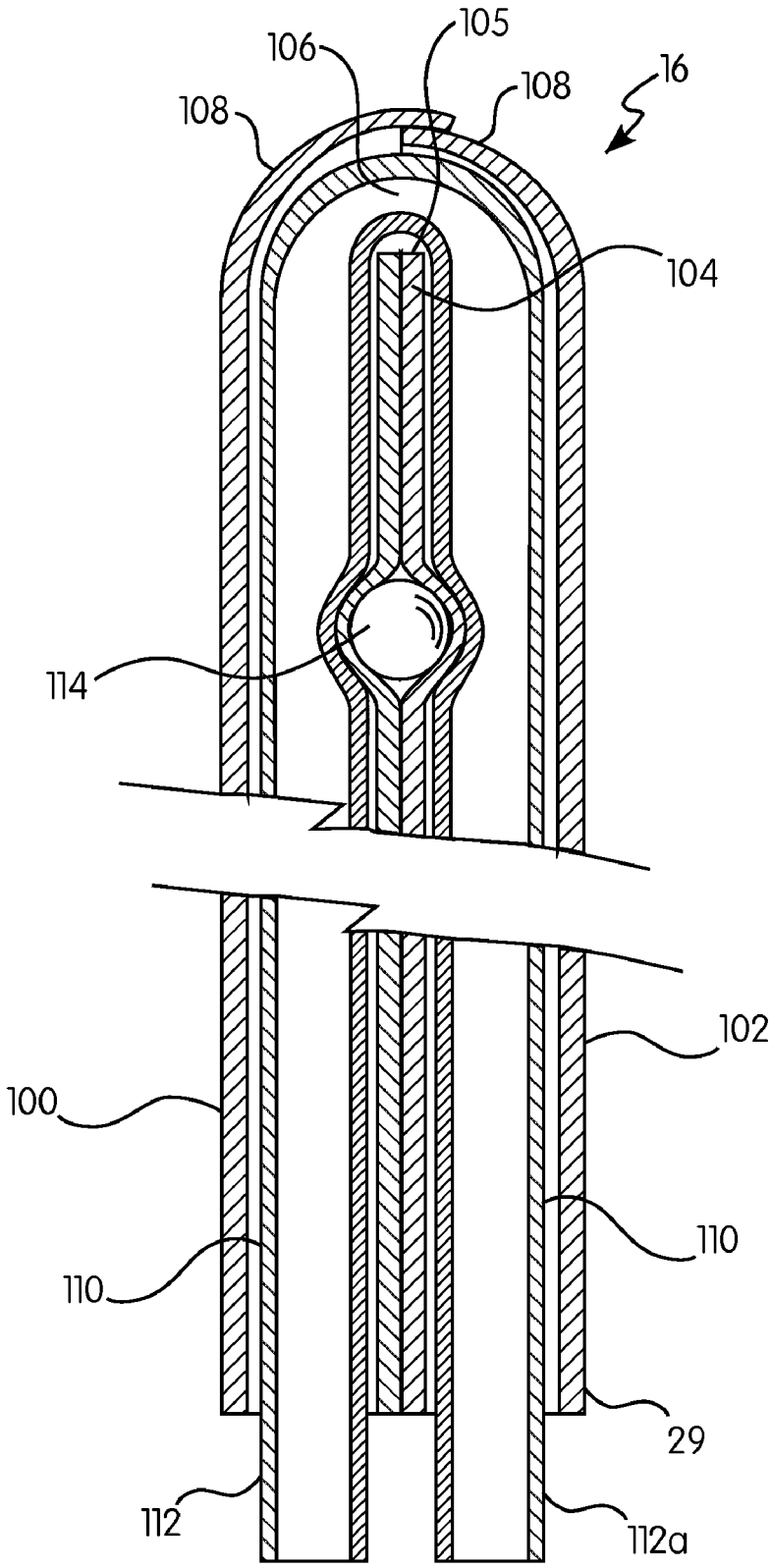
FIG. 17 is a longitudinal sectional view of an example of a bow structure prior to molding.

FIG. 17 illustrates generally a process which may be used to make the bow limb and riser. A pair of prepreg tubes 100, 102 extends side-by-side from the butt end 29 towards the tip end 16. At the tip end, the inside, common wall 104 of the tubes 100, 102 is cut out, the outside walls of the prepreg tubes 100, 102 are folded over one another, so as to close off the forward end and create a space 106 between the outside walls 108 and the forward end 105 of the common wall 104.

An inflatable bladder 110 extends through the interior of one prepreg tube 100, through the space 106 at the forward tip 16, and back through the other prepreg tube 102, so that opposite ends 112, 112*a* of the bladder 110 extend out of the open butt end 29 of the tubes. A mold pin 114 is inserted between the facing walls 104 of the tubes 110, 112 to form a port. This structure is then placed in a mold which is heated, while the bladder 110 is inflated, to form the bow limb. After molding a cap may be secured by any suitable means to close off the butt end 29 of the bow.

Alternately, the bow can be molded with the butt end 29 closed and the tip end 16 open (i.e., the opposite of FIG. 17), in which case the bow tip is secured after molding. Or, the bow limb can be molded with both ends open, using a pair of inflatable bladders. In either such case, the tip and/or butt may, if desired, be closed off after molding by securing a tip and/or butt piece, respectively, to the bow limb. In such a case, the ends of the tubes would not be folded over one another.

With respect to the above description then, it is to be realized that the optimum dimensional relationships for the parts of the invention, to include variations in size, materials, shape, form, function and manner of operation, assembly and use, are intended to be within the scope of the invention, and all equivalent relationships to those illustrated in the drawings and described in the specification are also intended to be encompassed by the present invention. Also, it is to be understood that the phraseology and terminology employed herein are for the purpose of descriptions and should not be regarded as limiting.

Therefore, the foregoing is considered as illustrative only of the principles of the invention. It is not desired to limit the invention to the exact construction and operation shown and described, and accordingly, all suitable modifications and equivalents may be resorted to, without deviating from the scope of the invention.

We claim:

1. An archery bow having a frame comprising a riser portion with opposite ends, and first and second limb portions extending, respectively, from said opposite ends, wherein said frame has a longitudinal axis;

wherein at least one of said portions comprises at least two hollow tubes, each of said two tubes having a length, the tubes having facing surfaces and non-facing surfaces along their length;

wherein portions of said tubes have generally flat facing surfaces which are fused together along fused portions to form an integral interior wall of the one said portion, and wherein non-facing surfaces of said fused portions form external surfaces of said fused portions;

wherein, in said fused portions, the external surface of one tube adjoins the external surface of the other tube on opposite sides of said portion to define a hollow interior of the bow such that said interior wall extends from adjoining external surfaces of said hollow tubes on one side of said portion, through the hollow interior of said portion, to adjoining exterior surfaces of said hollow tubes on an opposite side of said portion;

wherein said tubes are separated from one another at one or more locations between fused portions such that facing surfaces of said tubes at the separated locations define one or more ports which extend through the frame in a direction at least generally perpendicular to the length of the tubes, the ports being defined by separated, facing surfaces of the tubes, wherein said ports are formed without forming holes through either tube; and wherein the tubes comprise a composite material including a plurality of fiber layers, the composite material extending continuously along said fused portions and the one or more locations at which the tubes are separated to form one or more ports.

2. A bow as defined in claim 1, wherein said riser, and each of said limbs, contains one or more of said ports.

3. The archery bow of claim 1, wherein said limbs are constructed from an even number of tubes, wherein each bow limb contains at least one of said one or more ports, and further wherein said one or more ports are aligned along said longitudinal axis of said bow.

4. The archery bow of claim 1, wherein said bow limbs are constructed from an odd number of tubes, wherein each bow limb contains at least one of said one or more ports, and further wherein said one or more ports are offset from said longitudinal axis of said bow.

5. The archery bow of claim 1, wherein said one or more ports comprise at least two ports formed in said riser, wherein at least one of said two ports has an axis oriented in a first direction and another of said two ports has an axis oriented in a second direction orthogonal to said first direction.

6. The archery bow of claim 5 wherein at least one port having an axis oriented in said first direction and at least one port having an axis oriented in said second direction are collocated on said riser portion, forming a port having four openings.

7. The archery bow of claim 1, wherein said bow limbs and said riser portion are composed of a composite material.

8. The archery bow of claim 7 wherein said composite material is a fiber reinforced resin.

9. The archery bow of claim 8 wherein said fibers are selected from a group consisting of carbon, fiberglass, aramid and boron and further wherein said resin is selected from a group consisting of epoxy, polyester, vinyl ester, nylon, polyamide resins, ABS and PBT.

10. The archery bow of claim 1, further comprising an insert member composed of an elastomeric material, said insert member being disposed in one or more of said ports.

11. The archery bow of claim 1, wherein said bow limbs or said riser comprise a portion constructed from a single tube fused to a portion constructed from two or more tubes, said one or more ports being defined in said portion of said bow limbs or said riser being constructed from two or more tubes.

12. The archery bow of claim 1, wherein said bow limbs and said riser portion are formed from the same two or more tubes, forming a single structure.

13. The archery bow of claim 1, wherein at least a portion of said bow comprises a single metal tube joined to a multi-tube member.

14. The archery bow of claim 1, wherein said riser portion comprises three or more hollow tubes and further wherein said riser contains one or more irregularly-shaped ports therein.

15. The archery bow of claim 14 wherein the longitudinal axes of each of said three tubes are irregularly-shaped and at least portions of axes of said three tubes are oriented in a non-parallel relationship with respect to each other.

16. The archery bow of claim 15 further comprising an attachment member disposed at either end of said riser, for facilitating the attachment of said bow limbs to said riser.

17. The archery bow of claim 16 wherein said attachment members are pre-formed.

18. The archery bow of claim 17 wherein said attachment members are composed of a material selected from a group consisting of a composite material, metal or ceramic.

19. The archery bow of claim 18 wherein said attachment members are co-molded with said riser portion.

20. The archery bow of claim 18 wherein said attachment members are mechanically joined to said riser portion.

21. The archery bow of claim 19 further comprising one or more inserts disposed within said one or more ports, said one or more inserts being selected from a group consisting of accessory attachment members, weights and vibration damping members.

* * * * *